US006386079B2

(12) United States Patent
Hoopman

(10) Patent No.: US 6,386,079 B2
(45) Date of Patent: May 14, 2002

(54) METHOD AND APPARATUS FOR KNURLING A WORKPIECE, METHOD OF MOLDING AN ARTICLE WITH SUCH WORKPIECE, AND SUCH MOLDED ARTICLE

(75) Inventor: Timothy L. Hoopman, River Falls, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/821,611

(22) Filed: Mar. 29, 2001

Related U.S. Application Data

(62) Division of application No. 09/385,785, filed on Aug. 30, 1999, now Pat. No. 6,238,611, which is a division of application No. 08/923,862, filed on Sep. 3, 1997, now Pat. No. 5,946,991.

(51) Int. Cl.[7] ..... B23B 29/00; B23B 29/04

(52) U.S. Cl. ..... 82/158; 82/161; 82/46; 82/53; 72/703

(58) Field of Search ..... 82/1.11, 46, 53, 82/113, 158, 161; 72/703, 102, 108, 122; 29/DIG. 23; 451/547

(56) References Cited

U.S. PATENT DOCUMENTS

| | | | | |
|---|---|---|---|---|
| 413,625 | A | * 10/1889 | Moore | 72/95 |
| 1,151,829 | A | 8/1915 | Schliker | |
| 1,414,668 | A | 5/1922 | Reed | |
| 1,949,512 | A | 3/1934 | Norton | |
| 1,988,065 | A | 1/1935 | Wooddell | |
| 1,989,651 | A | 1/1935 | Drummond | |
| 2,245,654 | A | 6/1941 | Drader et al. | |
| 2,378,261 | A | 6/1945 | Turney | |
| 2,546,058 | A | 3/1951 | Boulet | |

(List continued on next page.)

FOREIGN PATENT DOCUMENTS

| | | |
|---|---|---|
| DE | 1 278 276 | 9/1968 |
| EP | 0 393 540 | 10/1990 |
| FR | 1151256 | 1/1958 |
| FR | 1583011 | 10/1969 |
| FR | 2299123 | 8/1976 |
| GB | 235 517 | 2/1926 |
| GB | 458373 | 12/1936 |
| GB | 663 554 | 12/1951 |
| GB | 1217378 | 12/1970 |
| SU | 1556857 | 4/1990 |
| WO | WO 94/27787 | 12/1994 |
| WO | WO 95/07797 | 3/1995 |
| WO | WO 95/22436 | 8/1995 |
| WO | WO 97/12727 | 4/1997 |

OTHER PUBLICATIONS

Instruction for Zeus Form and Cut Type Knurling Tools Brochure.

Catalog No. 3, *Eaglerock Technologies*, published by Eaglerock Technologies International Corp., B–13, 15 Merry Lane, P.O. Box 332, East Hanover, New Jersey 07936 USA.

"How The Surface Relief Of Abrasive Belts Affects Efficiency In Grinding Jobs" from Soviet Engineering Research vol. 9, No. 6(1989) New York, pp. 103–106 Search Report.

*Primary Examiner*—Henry Tsai
(74) *Attorney, Agent, or Firm*—Gregory D. Allen

(57) ABSTRACT

A method and apparatus for knurling a workpiece in which the knurl pattern includes grooves of at least two different configurations. The apparatus includes a knurl wheel holder that allows angular rotation of the knurl wheel about the holder longitudinal axis while maintaining the knurl wheel point of contact on the longitudinal axis. The apparatus also includes a knurling wheel that includes teeth of at least two different configurations. Also disclosed is a method of molding a molded article with the knurled workpiece to impart the inverse of the knurl pattern onto the molded article, such a molded article, a method of forming a structured abrasive article with the molded article, and such an abrasive article.

2 Claims, 13 Drawing Sheets

U.S. PATENT DOCUMENTS

| | | | | | |
|---|---|---|---|---|---|
| 2,579,611 | A | | 12/1951 | Poorman | |
| 2,684,604 | A | | 7/1954 | Froberg, Jr. | |
| 2,796,779 | A | * | 6/1957 | Miller | 72/108 |
| 2,870,661 | A | | 1/1959 | Poorman | |
| 2,870,662 | A | | 1/1959 | Poorman | |
| 3,017,697 | A | | 1/1962 | Wlodek | |
| 3,055,240 | A | | 9/1962 | Patzman et al. | |
| 3,133,344 | A | | 5/1964 | Keasker | |
| 3,689,346 | A | | 9/1972 | Rowland | |
| 3,765,208 | A | | 10/1973 | Cozert, Jr. | |
| 3,924,430 | A | | 12/1975 | Plevyak | |
| 3,972,212 | A | | 8/1976 | Brinkman | |
| 4,030,331 | A | | 6/1977 | Keasling | |
| 4,085,553 | A | | 4/1978 | Prunier | |
| 4,114,415 | A | | 9/1978 | Vodopyanov et al. | |
| 4,257,250 | A | | 3/1981 | Vanderhorst et al. | |
| 4,385,429 | A | | 5/1983 | Crankshaw | |
| 4,576,850 | A | | 3/1986 | Mertens | |
| 4,584,861 | A | | 4/1986 | Bartilson et al. | |
| 4,706,529 | A | | 11/1987 | Hawie | |
| 5,015,266 | A | | 5/1991 | Yamamoto | |
| 5,046,226 | A | | 9/1991 | Che | |
| 5,152,917 | A | | 10/1992 | Pieper et al. | |
| 5,156,863 | A | | 10/1992 | Pricone et al. | |
| 5,197,317 | A | | 3/1993 | Della Torre | |
| 5,435,816 | A | | 7/1995 | Spurgeon et al. | |
| 5,437,754 | A | | 8/1995 | Calhoun | |
| 5,453,312 | A | | 9/1995 | Haas et al. | |
| 5,489,235 | A | | 2/1996 | Gagliardi et al. | |
| 5,581,989 | A | | 12/1996 | Mann et al. | |
| 5,658,184 | A | | 8/1997 | Hoopman et al. | |
| 5,670,188 | A | | 9/1997 | May et al. | |
| 5,681,217 | A | | 10/1997 | Hoopman et al. | |
| 5,992,199 | A | * | 11/1999 | Giannetti | 72/108 |
| 6,129,540 | A | | 10/2000 | Hoopman et al. | |

* cited by examiner

METHOD AND APPARATUS FOR KNURLING A WORKPIECE, METHOD OF MOLDING AN ARTICLE WITH SUCH WORKPIECE, AND SUCH MOLDED ARTICLE

This application is a Divisional of U.S. application Ser. No. 09/385,785, filed Aug. 30, 1999, is now 6,238,611 which is a Divisional of U.S. application Ser. No. 08/923,862, filed Sep. 3, 1997, issued as U.S. Pat. No. 5,946,991 on Sep. 7, 1999.

TECHNICAL FIELD

The present invention relates to a method and apparatus for knurling a pattern having two or more different configurations of grooves in a workpiece, and an article molded with the knurled workpiece. Such a molded article is useful for making an abrasive article in which a structured abrasive coating is provided on a substrate, among many other uses.

BACKGROUND OF THE INVENTION

Two general methods of knurling are known. Knurling is typically performed by the first knurling process, referred to as roll knurling or form knurling. Form knurling is done by pressing a knurling wheel against a workpiece with sufficient force to plastically deform the outer surface of the workpiece. The second knurling process, referred to as cut knurling, is performed by orienting the knurling wheel relative to the workpiece such that the wheel cuts a pattern into the workpiece by removing metal chips. Cutting knurl holders and cutting knurl wheels are available from Dorian Tool International, Houston, Tex. Zeus brand cutting knurl tools are available from Eagle Rock Technologies Int'l Corp. of Bath, Pa.

In form knurling, the rotational axis of the knurl wheel is parallel to the rotational axis of the cylindrical workpiece. Therefore, the helix angle of the grooves formed on the roll is defined by the helix angle of the teeth on the knurl wheel. For cut knurling, the rotational axis of the cutting knurl wheel is tilted with respect to the rotational axis of the cylindrical workpiece ("the tilt angle") to define the helix angle and to produce the cutting action. Because the edge of the knurl wheel is being used as a cutting tool, it is necessary to provide a clearance angle. This is achieved by positioning the knurl wheel so that at the point of contact of the knurl wheel and workpiece surface, the toothed cylindrical surface of the knurl wheel and the workpiece surface form an angle of 3 to 10 degrees.

In both of the above types of knurling processes, the structure generated in the workpiece is a plurality of continuous grooves having a cross-section similar to the shape of the teeth on the knurl wheel. Both conventional knurling processes typically impart a diamond-based pattern which is the result of the intersection of two sets of continuous grooves, the two sets having opposite and equal helix angles (one having a left hand ("LH") helix and one having a right hand ("RH") helix) relative to a cylindrical workpiece. The intersection of the two sets of grooves creates a diamond pattern in the outer surface of the workpiece. The diamonds are aligned in the direction perpendicular to the longitudinal axis of the cylindrical workpiece, and are all substantially identical to one another. Conventional knurling processes have also been used to impart a square-based pattern, in which the squares are oriented to have their sides at 45° to the longitudinal axis of the workpiece. As with the diamond-based pattern, the square-based pattern is also aligned in the direction perpendicular to the longitudinal axis of the cylindrical workpiece, and all of the square-based pyramids are identical. These processes are typically used to impart a non-slip pattern on a tool handle, machine control knob, or the like.

In common commercially available cut knurling holders, the knurl wheel tilt angle is fixed at ±30° relative to the rotational axis of the cylindrical workpiece. Holders providing a ±45° knurl wheel tilt angles are also available. Knurl wheels with teeth having helix angles relative to the rotational axis of the wheel of 0°, 15° RH, 30° RH, 15° LH and 30° LH are readily available. The sum of the tilt angle and the tooth helix angle defines the groove helix angle in the workpiece. The permutations of arithmetic sums of these wheel axis tilt angles and knurl teeth helix angles can produce groove helix angles on the cylindrical workpiece surface at 0°, 15°, 30°, 45°, 60° and 75° RH or LH to the workpiece rotational axis. If a groove helix angle on the workpiece surface other than these angles is desired, a special knurl wheel and/or knurl holder must be fabricated.

WIPO International Patent Application Publication Number WO 97/12727, published on Apr. 10, 1997, "Method and Apparatus for Knurling a Workpiece, Method of Molding an Article With Such Workpiece, and Such Molded Article," Hoopman et al., discloses a method and apparatus for knurling a workpiece in which the two sets of intersecting grooves each have a helix angle of unequal magnitude and opposite direction. The resulting knurl pattern is therefore not aligned in the cylindrical direction of the workpiece. Hoopman et al. also discloses a method of molding a molded article with the knurled workpiece to impart the inverse of the knurl pattern onto the molded article, and a method of forming a structured abrasive article with the molded article. The structured abrasive coating comprises abrasive particles and a binder in the form of a precise, three dimensional abrasive composites molded onto the substrate.

Other structured abrasives, and methods and apparatuses for making such structured abrasives, are described in U.S. Pat. No. 5,152,917, "Structured Abrasive Article," (Pieper et al.), issued Oct. 6, 1992, the entire disclosure of which is incorporated herein by reference.

WIPO International Patent Application Publication Number WO 95/07797, "Abrasive Article, Method of Manufacture of Same, Method of Using Same for Finishing, And a Production Tool," (Hoopman et al.), published Mar. 23, 1995, discloses a structured abrasive article in which the abrasive composites are not all identical. Hoopman et al. provides differing dimensioned shapes, among other things, in the array of abrasive composites. A copy of a desired pattern of variably dimensioned shapes of abrasive composites can be formed in the surface of a so-called metal master, e.g., aluminum, copper, bronze, or a plastic master such as acrylic plastic, either of which can be nickel-plated after grooving, as by diamond turning grooves to leave upraised portions corresponding to the desired predetermined shapes of the abrasive composites. Then, flexible plastic production tooling can be formed, in general, from the master by a method explained in U.S. Pat. No. 5,152,917 (Pieper et al.).

Other examples of structured abrasives and methods and apparatuses for their manufacture are disclosed in U.S. Pat. No. 5,435,816, "Method of Making an Abrasive Article," (Spurgeon et al.), issued Jul. 25, 1995, the entire disclosure of which is incorporated herein by reference. In one embodiment, Spurgeon et al. teaches a method of making an abrasive article comprising precisely spaced and oriented abrasive composites bonded to a backing sheet. Spurgeon et al. teaches that, in addition to other procedures, a thermoplastic production tool can be made according to the following procedure. A master tool is first provided. The master tool is preferably made from metal, e.g., nickel. The master tool can be fabricated by any conventional technique, such as engraving, hobbing, knurling, electroforming, diamond turning, laser machining, etc. The master tool should have the inverse of the pattern for the production tool on the surface thereof. The thermoplastic material can be embossed with the master tool to form the pattern. While Spurgeon et al. mentions briefly that the master tool can be made by knurling, no specific method of knurling a master tool is shown, taught, or suggested by Spurgeon et al.

Thus it is seen that there is a need for a knurling apparatus and method that allows the knurl wheel to be held at any desired angle relative to the rotational axis of a cylindrical workpiece. There is also a need to provide a knurling apparatus and method in which the knurling pattern in the workpiece comprises groove structures of at least two different configurations.

SUMMARY OF THE INVENTION

One aspect of the present invention provides a method of knurling a cylindrical surface of a workpiece, the workpiece having a longitudinal axis. The method comprises the steps of: a) imparting a first plurality of grooves to a workpiece, wherein the first plurality of grooves has a first helix angle with respect to the longitudinal axis of the workpiece; wherein the first plurality of grooves includes a first groove and a second groove, the second groove being of substantially different configuration from the first groove; and b) imparting a second plurality of grooves to the workpiece, wherein the second plurality of grooves has a second helix angle with respect to the longitudinal axis. The second plurality of grooves intersects the first plurality of grooves, thereby imparting a knurl pattern to the outer surface of the workpiece.

In one preferred embodiment of the above method, the second plurality of grooves includes a third groove and a fourth groove, the fourth groove being of substantially different configuration from the third groove. In one preferred version of this embodiment, the third and fourth grooves each comprise a first groove surface, a second groove surface, and a groove base. The first and second groove surfaces each extend from an outer surface of the workpiece to the groove base. The groove surfaces of the third groove are at a third included angle to one another, the surfaces of the fourth groove are at a fourth included angle to one another, and the fourth included angle is substantially different from the third included angle. In one preferred embodiment, the third and fourth included angles differ by at least 3 degrees. In another preferred embodiment, the third and fourth included angles differ by at least 10 degrees.

In another preferred embodiment of the above method, the first and second grooves each comprise a first groove surface, a second groove surface, and a groove base. The first and second groove surfaces each extend from an outer surface of the workpiece to the groove base. The groove surfaces of the first groove are at a first included angle to one another, and the surfaces of the second groove are at a second included angle to one another. The second included angle is substantially different from the first included angle. In one preferred version of this embodiment, the first and second included angles differ by at least 3 degrees. In another preferred version of this embodiment, the first and second included angles differ by at least 10 degrees. In another preferred version of this embodiment, the groove base is a line formed at the juncture of the first and second groove surfaces.

In yet another preferred embodiment of the above method, the intersection of the first plurality of grooves and second plurality of grooves forms a plurality of pyramids on the outer surface of the workpiece. Each of said pyramids includes first opposed side surfaces formed by the first grooves and second opposed side surfaces formed by the second grooves. The plurality of pyramids includes a first pyramid and a second pyramid, the second pyramid being of substantially different configuration from the first pyramid. In one preferred embodiment, the opposed first sides of the first pyramid form a first angle therebetween, the opposed first surfaces of the second pyramid form a second angle therebetween, and the second angle is at least 3 degrees different from the first angle. In another preferred embodiment, the second angle is at least 10 degrees different from the first angle. In another preferred embodiment, the pyramids are truncated pyramids.

In still another preferred embodiment of the above method, the pattern is continuous and uninterrupted around the circumference of the workpiece.

In still another preferred embodiment of the above method, the first and second groove helix angles are of substantially unequal magnitude.

Another aspect of the present invention provides a knurled workpiece made according to the above method.

Yet another aspect of the present invention provides a method of molding a molded article with the just-described knurled workpiece. This method comprises the steps of: a) applying a moldable material to the outer surface of the workpiece; b) while the moldable material is in contact with the workpiece, applying sufficient force to the moldable material to impart the inverse of the pattern on the outer surface of the workpiece to a first surface of the moldable material in contact with the workpiece; and c) removing the moldable material from the workpiece.

In yet another aspect, the present invention provides a molded article made in accordance with the just-described method.

The present invention also provides a knurled workpiece having a knurled, cylindrical outer surface. The knurled workpiece comprises: a cylindrical body having a longitudinal axis and an outer cylindrical surface, the outer surface having a knurl pattern thereon. The knurl pattern comprises a first plurality of grooves having a first helix angle with respect to the longitudinal axis of said workpiece. The first plurality of grooves includes a first groove and a second groove, the second groove being of a substantially different configuration from said first groove. The knurl pattern also comprises a second plurality of grooves. The second plurality of grooves has a second helix angle with respect to the longitudinal axis. The second plurality of grooves intersects the first plurality of grooves.

In one preferred embodiment of the above knurled workpiece, the second plurality of grooves includes a third groove and a fourth groove, the fourth groove being of a substantially different configuration from the third groove.

In another preferred embodiment of the above knurled workpiece, the first and second grooves each comprise a first groove surface, a second groove surface, and a groove base. The first and second groove surfaces each extend from the workpiece outer surface to the groove base. The groove surfaces of the first groove are at a first included angle to one another and the groove surfaces of the second groove are at a second included angle to one another, the second included angle being substantially different from the first included angle. In one preferred embodiment, the first and second included angles differ by at least 3 degrees. In another preferred embodiment, the first and second included angles differ by at least 10 degrees.

In another preferred embodiment of the above knurled workpiece, the third and fourth grooves each comprise a first groove surface, a second groove surface, and a groove base. The first and second groove surfaces each extend from the workpiece outer surface to the groove base. The groove surfaces of the third groove are at a third included angle to one another and the groove surfaces of the fourth groove are at a fourth included angle to one another, the fourth included angle being substantially different from the third included angle. In one preferred embodiment, the third and fourth included angles differ by at least 3 degrees. In another preferred embodiment, the third and fourth included angles differ by at least 10 degrees.

In another preferred embodiment of the above knurled workpiece, the groove base is a line formed at the juncture of the first and second groove surfaces.

In another preferred embodiment of the above knurled workpiece, the intersection of the first plurality of grooves and the second plurality of grooves forms a plurality of pyramids on the workpiece outer surface. Each of the pyramids includes first opposed side surfaces formed by the first grooves and second opposed side surfaces formed by the second grooves. The plurality of pyramids includes a first pyramid and a second pyramid, the second pyramid being of substantially different configuration from the first pyramid. In one version of this embodiment, the opposed first sides of the first pyramid form a first angle therebetween, and the opposed first surfaces of the second pyramid form a second angle therebetween, and the second angle is at least 3 degrees different from the first angle. In one embodiment, the second angle is at least 10 degrees different from the first angle.

In another preferred embodiment of the above knurled workpiece, the pyramids are truncated pyramids.

In another preferred embodiment of the above knurled workpiece, the knurl pattern is continuous and uninterrupted around the circumference of the workpiece.

In another aspect, the present invention provides a method of molding a molded article with the above knurled workpiece. The method comprises the steps of:

a) applying a moldable material to the outer surface of the knurled workpiece;

b) while the moldable material is in contact with the knurled workpiece, applying sufficient force to the moldable material to impart the inverse of the pattern on the outer surface of the knurled workpiece to a first surface of the moldable material in contact with the knurled workpiece; and c) removing the moldable material from the knurled workpiece.

In another aspect, the present invention provides a molded article made in accordance with the just-described method.

In yet another aspect, the present invention provides an apparatus for holding a cutting knurl wheel. The apparatus comprises a main support body; a shaft including a first end, a second end, and a longitudinal axis, wherein the shaft is rotatably mounted in the main body so as to rotate about the longitudinal axis; a knurl wheel mount on the second end of the shaft; a knurl wheel rotatably mounted on the knurl wheel mount so as to rotate about a knurl wheel axis, the knurl wheel including a plurality of teeth on an outer periphery thereof. The knurl wheel axis intersects the shaft longitudinal axis at an oblique angle. Rotation of the knurl wheel about the knurl wheel axis defines a distal point that is the location furthest in the direction from the first end of the shaft to the second end of the shaft through which the knurl teeth pass. The distal point is on the shaft longitudinal axis. The knurl wheel mount and knurl wheel are configured such that the distal point remains located on the shaft longitudinal axis during rotation of the shaft about the longitudinal axis. In one preferred embodiment, the shaft longitudinal axis and the knurl wheel axis intersect at an angle of from 80 to 87 degrees.

In still another aspect, the present invention provides a knurl wheel. The knurl wheel comprises: a body including first and second major opposed surfaces and an outer peripheral surface between the first and second major surfaces; and a plurality of teeth on the outer peripheral surface. The plurality of teeth include a first tooth and a second tooth, the second tooth being of substantially different configuration from the first tooth.

In one preferred embodiment of the above knurl wheel, the first tooth includes first and second sides extending from the outer peripheral surface, the first and second sides forming a first included angle therebetween. The second tooth includes third and fourth sides extending from the outer peripheral surface and defining a second included angle therebetween, the second angle being substantially different from the first angle. In one preferred embodiment, the second angle differs from the first angle by at least 3 degrees. In another preferred embodiment, the second angle differs from the first angle by at least 10 degrees.

In another preferred embodiment of the above knurl wheel, each of the plurality of teeth have a substantially different configuration.

In another preferred embodiment of the above knurl wheel, each of the teeth includes a first side and a second side extending from the outer peripheral surface. A respective first edge of one of the teeth and a respective second edge of an adjacent one of the teeth form an included angle therebetween, thereby forming a plurality of included angles between each adjacent pair of teeth. A first one of the included angles is substantially different from a second one of the included angles. In one preferred embodiment, the first included angle differs from the second included angle by at least 3 degrees. In another preferred embodiment, the first included angle differs from the second included angle by at least 10 degrees. In another preferred embodiment, each of the included angles is substantially different.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

The present invention provides a knurling tool holder which holds a knurl wheel at a prescribed clearance angle and allows infinite adjustment of the angular orientation of the knurl wheel by rotating the knurl wheel about a holder axis "A" that: 1) intersects the point of contact of the knurl wheel and the cylindrical workpiece surface; 2) intersects the longitudinal axis of the cylindrical workpiece; and 3) is perpendicular to the longitudinal axis of the workpiece. The clearance angle $\beta$ is equal to the compliment of the angle $\alpha$ between the knurl wheel rotational axis C and the holder axis A (i.e., $\beta=90-\alpha$). As the tool holder rotates the knurl wheel about tool holder axis, there is virtually no change in clearance angle, depth of cut or axial position on the workpiece. Only the helical angle of the generated groove structure is changed. This allows cutting groove structure helical angles from 15° to 165° (where 0° is parallel to the axis 36 of the cylindrical workpiece, and where 90° is perpendicular to the axis of the workpiece thereby providing parallel circumferential groove structures) using a straight tooth cutter (i.e., the teeth are parallel to the rotational axis of the knurl wheel). At angles below 15° approaching 0°, the relative cutting velocities of the workpiece and knurl wheel approaches a pure rolling, or forming, engagement, and may not provide adequate cutting results. Therefore, for groove structure helical angles from 15° to 0°, it is preferable to use a knurl wheel which has negative 30° helical teeth and positioning the holder at angles which are at 45° to 30° to the roll axis. The generated structure helical angle is the arithmetic sum of the holder angle and the knurl wheel tooth angle (i.e. 45°−30°=15°, 37.8°−30°=7.8°, 30°−30°=0° and so on). A similar arrangement is used for helical angles from 165° to 180°

Knurl Tool Holder

Figure 1:
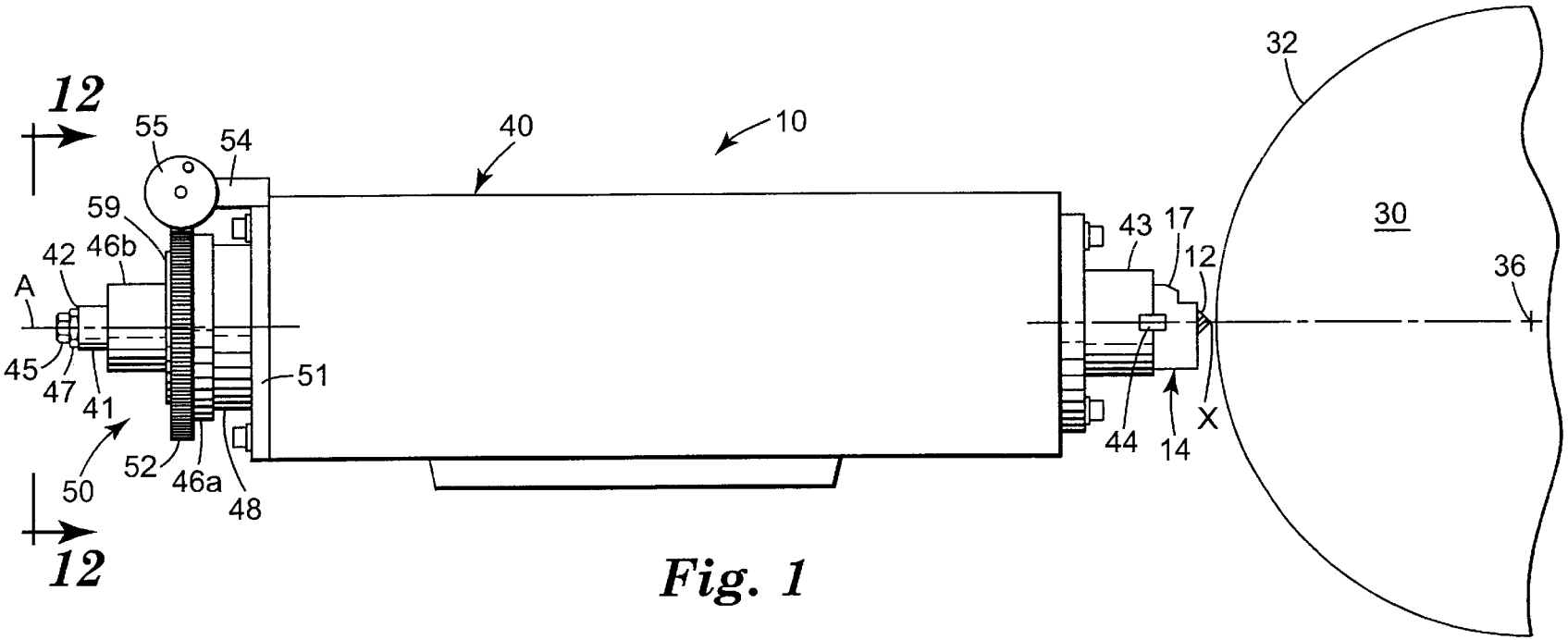
FIG. 1 is an elevational view of a preferred embodiment of a knurl tool holder of the present invention.
Figure 2:
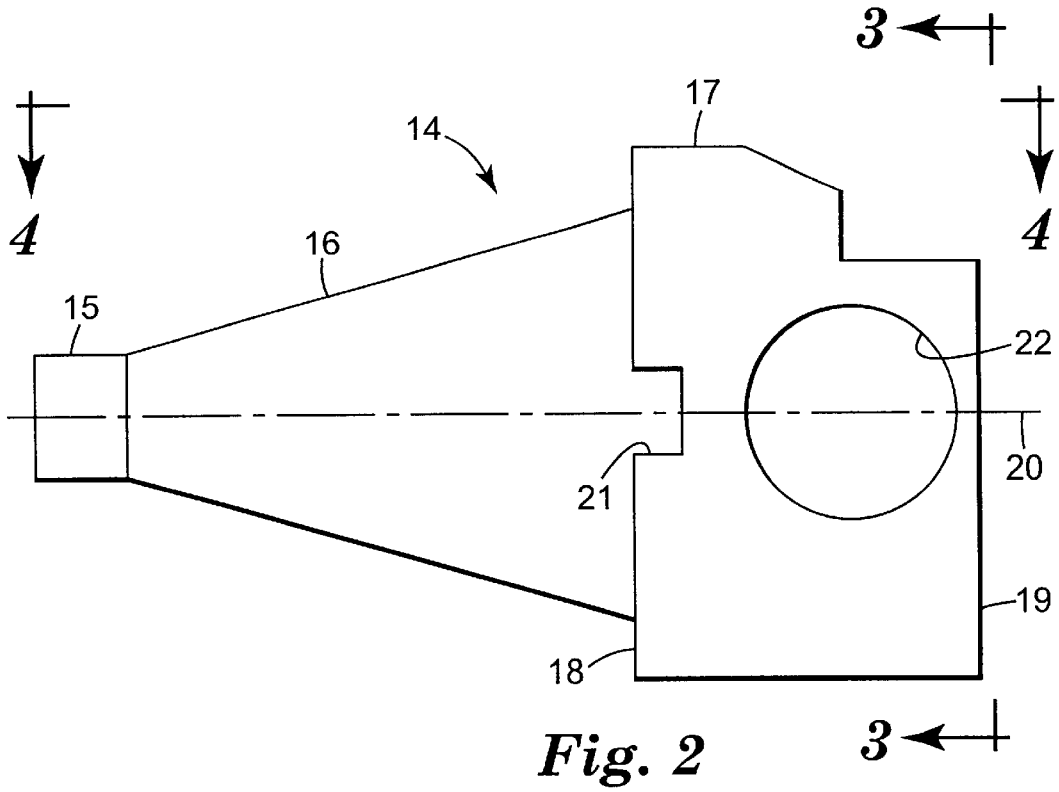
FIG. 2 is a side elevational view of a knurl mount according to the present invention, removed from the knurl tool holder of FIG. 1.

A preferred embodiment of a knurl tool holder 10 having a knurling wheel 12 mounted thereon is illustrated in FIG. 1. Tool holder 10 includes knurl tool mount 14, spindle 40, and rotational drive assembly 50. As discussed below in greater detail, operation of the drive assembly 50 causes the shaft 41 extending through spindle 40 to rotate, thereby rotating the knurl mount 14 to the desired angular orientation. The spindle 40, tool mount 14, and knurl wheel 12 are all sized and configured such that the knurl wheel rotates about axis A such that the forward-most point "X" on the knurl wheel 12 rotates about the axis A while remaining on axis A. Point X on the knurling wheel also extends beyond the front face 19 of knurl mount 14. Furthermore, the tool holder 10 is held in position relative to the workpiece 30 such that the tool holder axis A intersects and is perpendicular to the longitudinal axis 36 of the workpiece.

One suitable embodiment of the spindle 40 is a Gilman Model 40008-X3M-30 spindle, commercially available from Russell T. Gilman, Inc., of Grafton, Wis. It is understood that any spindle with sufficient strength and accuracy and that can be fitted with a knurl mounting fixture would suitable. Spindle 40 includes a shaft 41 rotationally mounted therein. The rotational axis of the shaft 41 defines axis A of the tool holder 10. The drive assembly 50 is operatively connected to the first end 42 of shaft 41, and knurl mount 14 is mounted to the second end 43 of the shaft.

Figure 3:
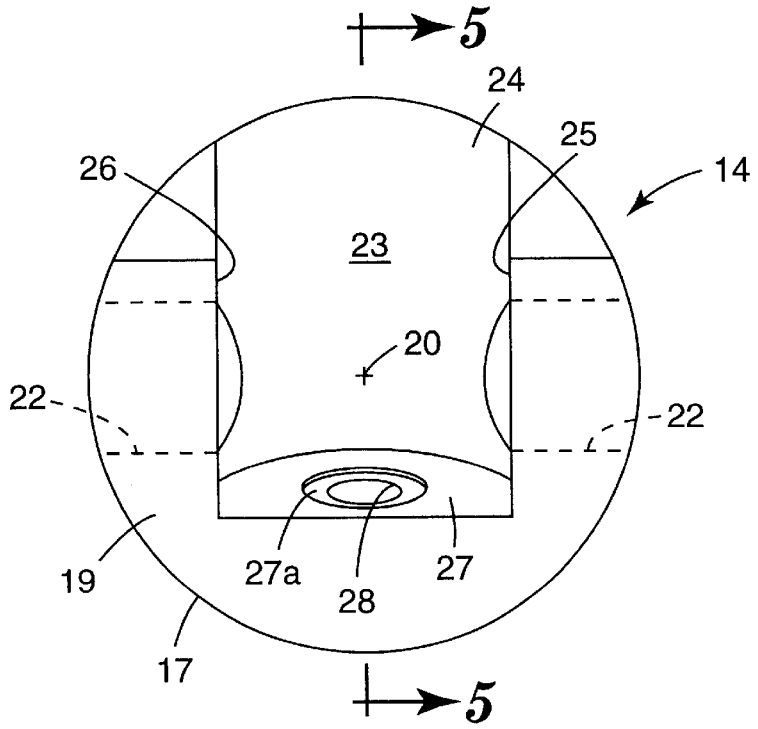
FIG. 3 is a front elevational view taken in direction 3—3 of the knurl mount of FIG. 2.
Figure 4:
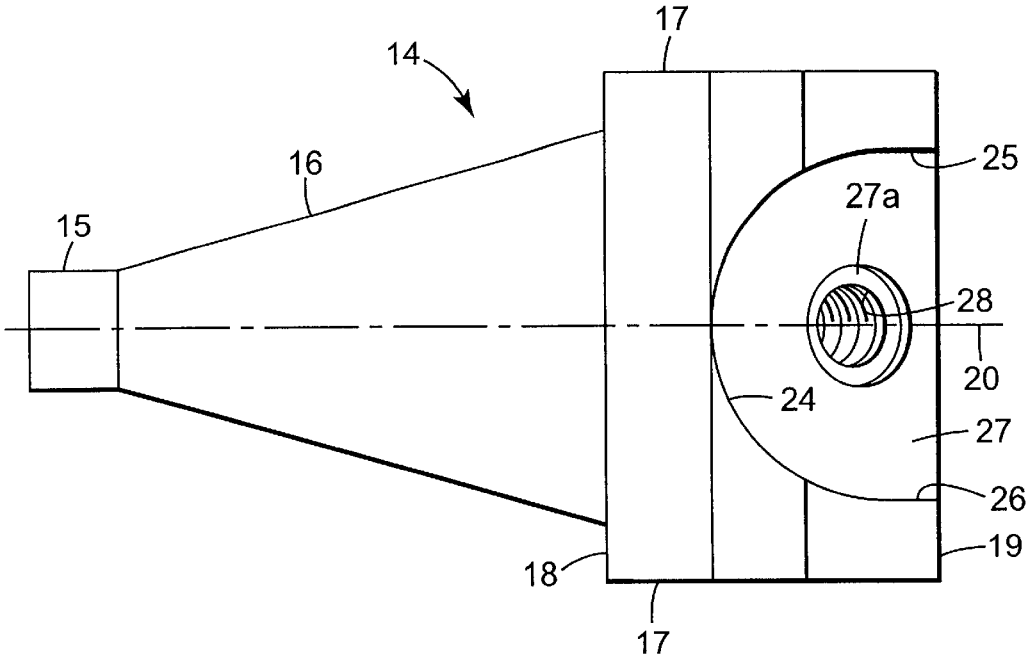
FIG. 4 is a top plan view taken in direction 4—4 of the knurl mount of FIG. 2.
Figure 5:
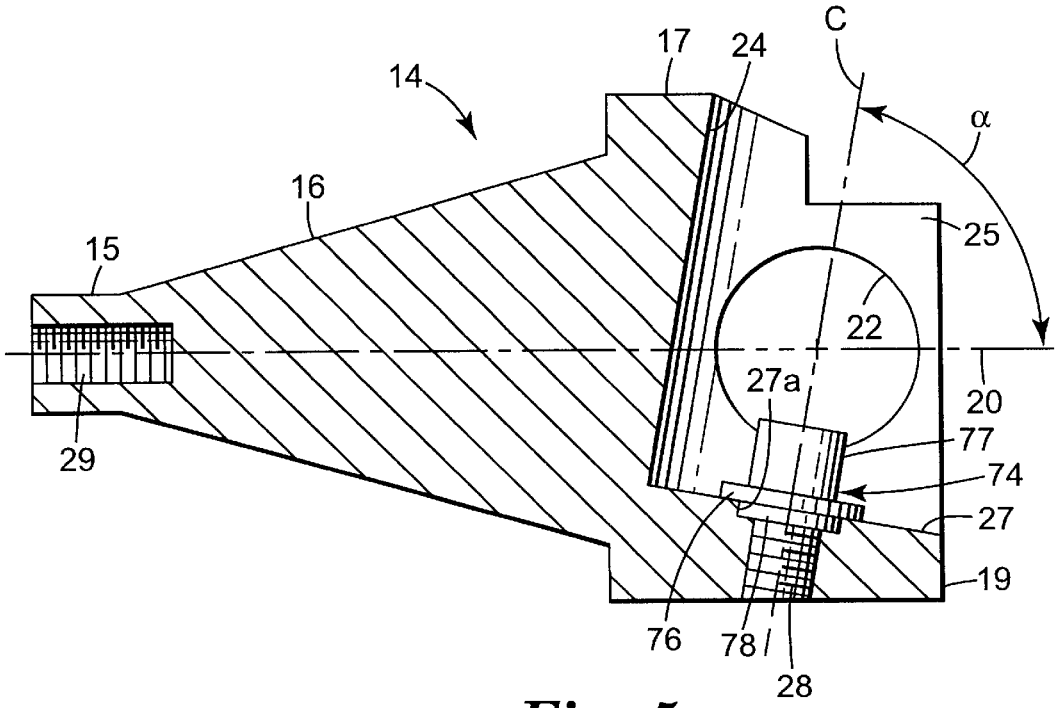
FIG. 5 is a cross-sectional view taken along line 5—5 of the knurl mount of FIG. 2.
Figure 13:
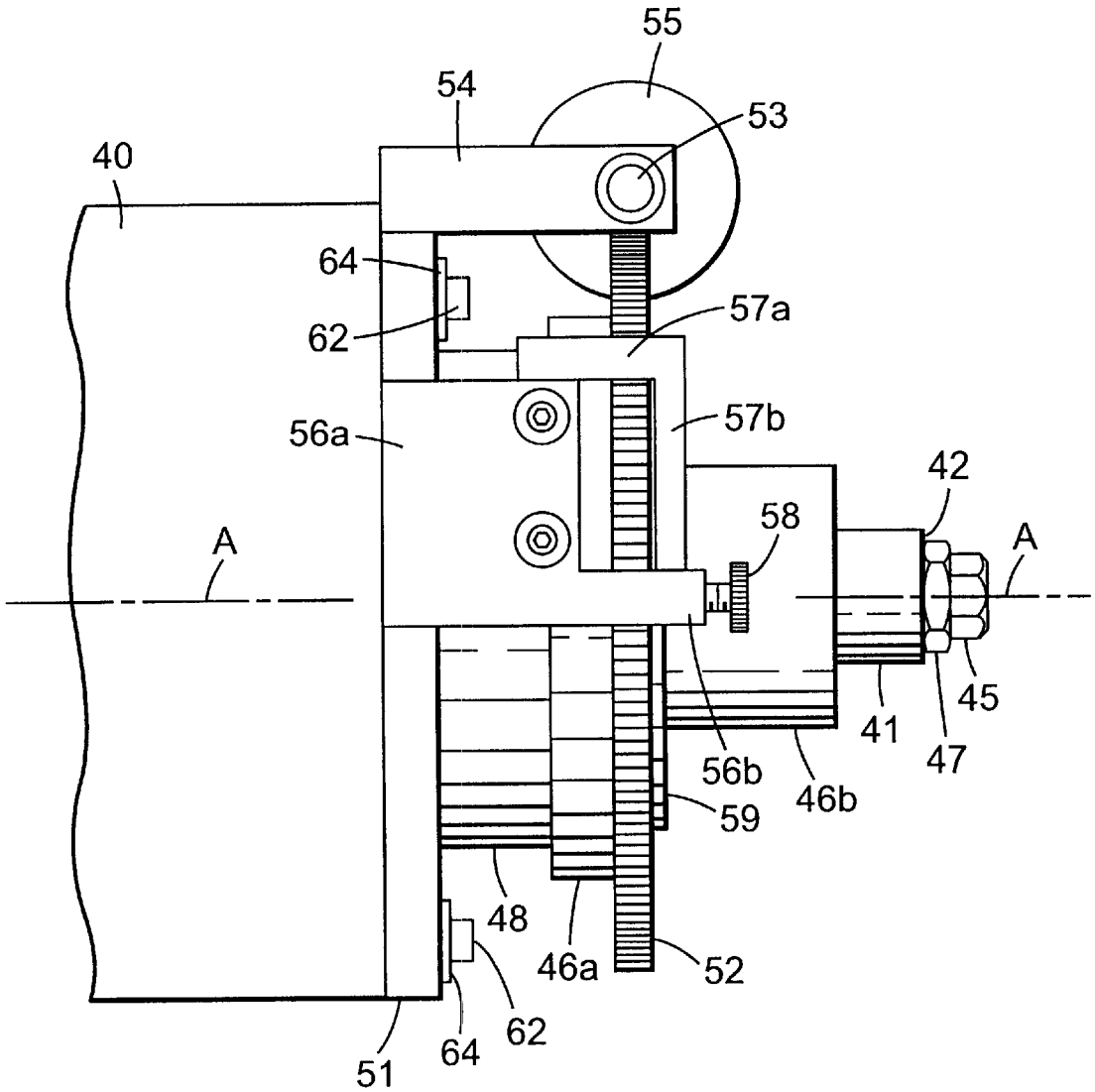
FIG. 13 is a side elevational view taken in direction 13—13 of the rotational drive assembly of FIG. 12.

FIGS. 2–5 illustrate knurl mount 14 removed from the holder 10, with knurl wheel 12 removed from the mount 14. One preferred embodiment of knurl mount 14 is fabricated from a NMTB taper shank adapter, standard blank number 73, available from Valenite Co., of Troy, Mich. Knurl mount 14 includes rear portion 15, central tapered portion 16, and forward portion 17. Tapered portion 16 fits into a like-shaped cavity on the second end 43 of shaft 41 to help center the knurl mount 14 relative to the shaft 41. In this manner, longitudinal axis 20 of the knurl mount 14 is coinident with rotational axis A of the tool holder 10. A keyway 21 is included on the rear face 18 of the forward portion 17 of the knurl mount, and mates with a key 44 mounted on the second end 43 of the shaft 41 to define the rotational or angular orientation of the knurl mount 14 relative to the shaft 41. As best seen in FIG. 5, threaded shaft mounting hole 29 extends into the rear portion 15 of the tool mount, for attachment to a corresponding bolt 45 extending through shaft 41. As illustrated in FIGS. 1 and 13, bolt 45 can be engaged with the knurl mount 14. Locking nut 47 is then tightened to pull the mount 14 into engagement with the second end 43 of shaft 41.

As best seen in FIGS. 3 and 4, forward portion 17 of knurl mount 14 includes knurl wheel receiving cavity 23. Cavity 23 is bounded by rear wall 24, first and second side walls 25, 26, and by mounting surface 27. Forward portion 17 can optionally include holes 22 in side walls 25, 26 for observing the wheel 12 mounted in the cavity 23, and for injecting coolant during knurling for chip removal.

As seen FIG. 4, mounting surface 27 is oriented such that the normal axis C to the mounting surface is not perpendicular to axis 20 of the knurl mount 14. Mounting surface 27 has therein threaded knurl mounting hole 28 surrounded by cylindrical shoulder 27*a*. Knurl wheel axle 74 is inserted in shoulder 27*a*. Axle 74 includes first portion 78 which closely fits within shoulder 27*a* and second portion 76 which rests on mount surface 27. Axle also includes shaft 77 on which knurl wheel 12 is mounted. Mounting hole 28, cylindrical shoulder 27*a*, and shaft 77 are oriented along normal axis C of the mounting surface 27. Normal axis C intersects longitudinal axis 20 of the knurl mount 14. Normal axis C defines the rotational axis of the knurl wheel 12 when mounted in the knurl mount 14. Normal axis C is oriented at angle $\alpha$ relative to the longitudinal axis 20 of the knurl holder 14. Angle $\alpha$ can be selected in light of the knurl wheel 12 to be used so as to provide the desired clearance angle $\beta$, where $\beta=90-\alpha$. Values for angle $\alpha$ of from 80° to 87° have been found suitable, with 85° preferred for some knurl patterns.

Figure 6:
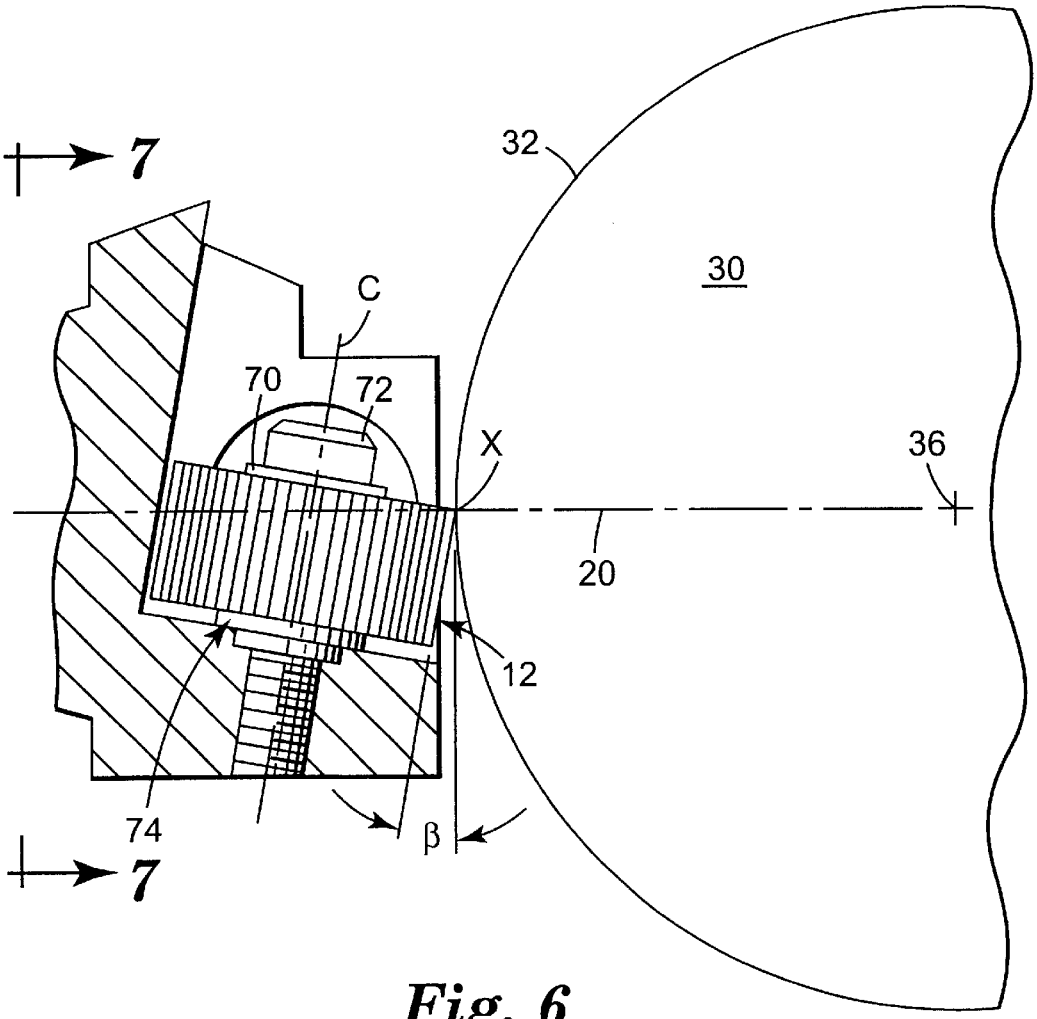
FIG. 6 is a view like FIG. 5 of the knurl mount having a knurling wheel 12 mounted thereon, shown in engagement with a cylindrical workpiece.
Figure 7:
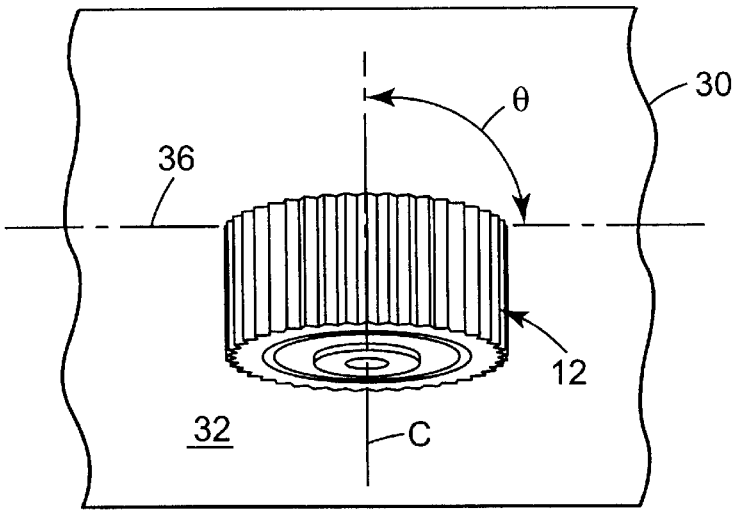
FIG. 7 is a view taken in direction 7—7 of the knurl wheel and workpiece of FIG. 6, with the knurl mount removed for clarity.

FIG. 6 illustrates the knurl mount 14 of FIG. 5 with knurl wheel 12 mounted on shaft 77. Cap 70 fits on top of knurl wheel 12, and screw 72 fits through the cap 70 and shaft 77 and engages in mounting hole 28 in the mount surface 27 of the knurl mount 14. Knurl wheel 12 thus rotates about axis C. Mount surface 27 is located relative to longitudinal axis 20 of the knurl mount such that the forward most portion X of the knurl wheel 12 is on longitudinal axis 20 and extends beyond the front face 18 of mount 14. It is thus seen that the diameter of wheel 12, the thickness of the wheel 12 along axis C, the thickness of first and second portions 76, 78 of axle 74, the position of mount surface 27 relative to the axis 20, and the magnitude of angle $\alpha$ all must be considered in selecting a configuration that places forward-most portion X of the knurl wheel 12 on axis 20.

Figure 8:
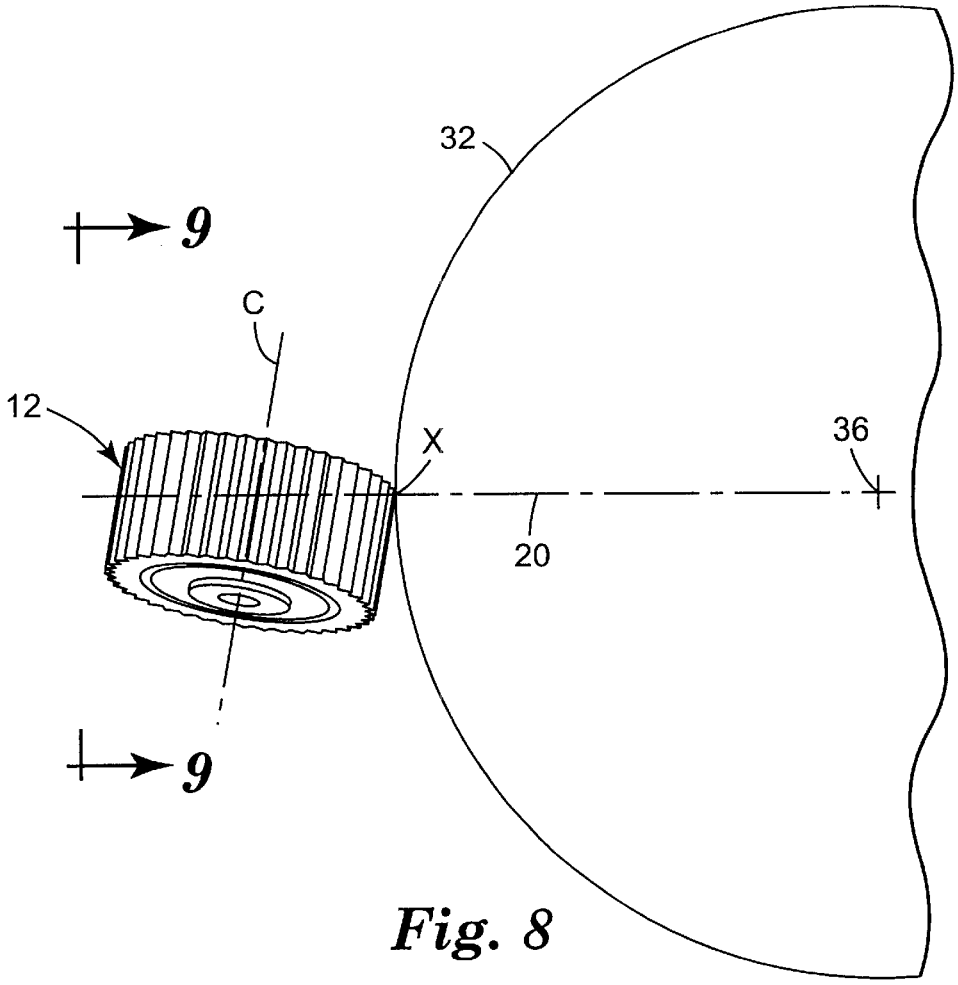
FIG. 8 is a view like FIG. 6 of the knurl wheel engaged at an alternative orientation with the workpiece, with the knurl holder removed for clarity.
Figure 9:
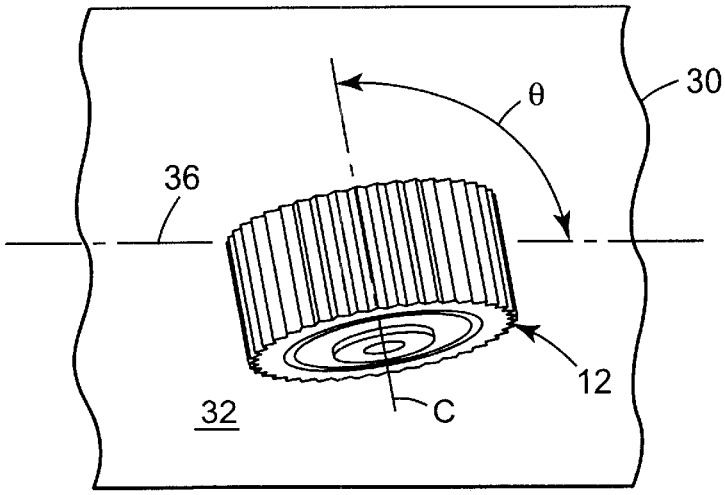
FIG. 9 is a view taken in direction 9—9 of the knurl wheel and workpiece of FIG. 8.
Figure 10:
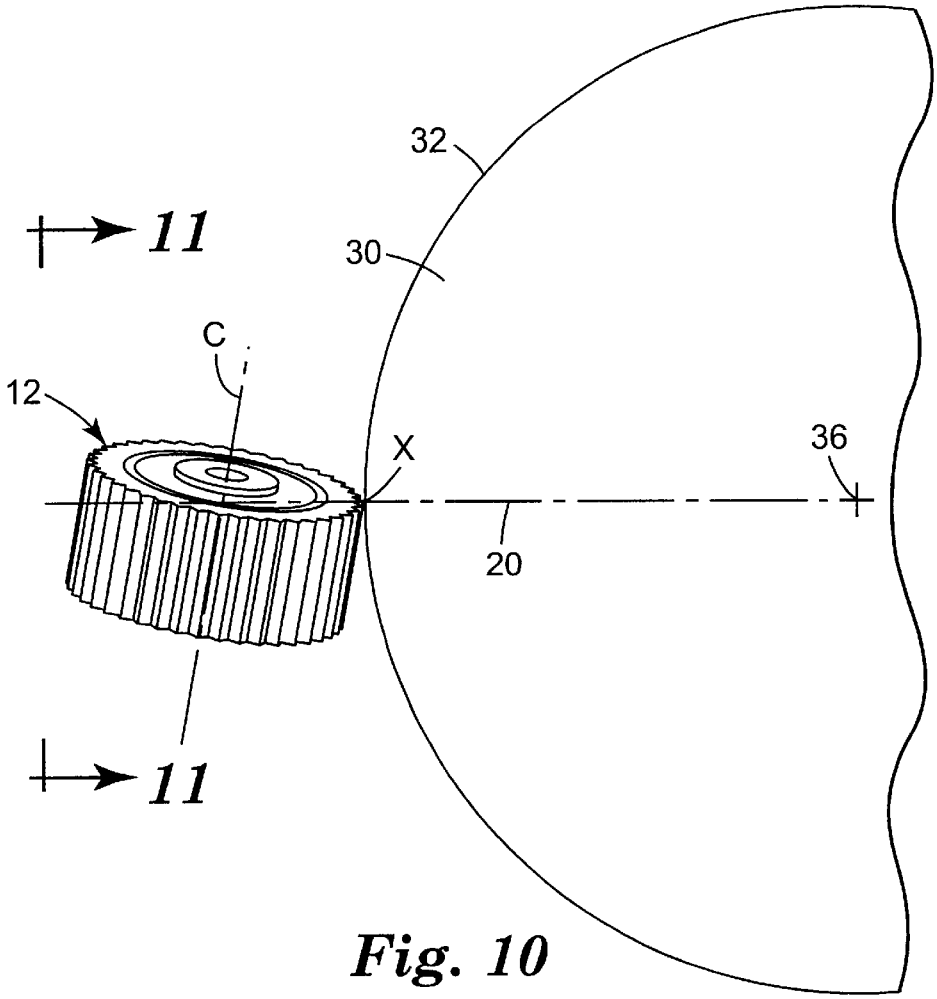
FIG. 10 is a view like FIG. 8 of the knurl wheel engaged at yet another orientation with the workpiece.
Figure 11:
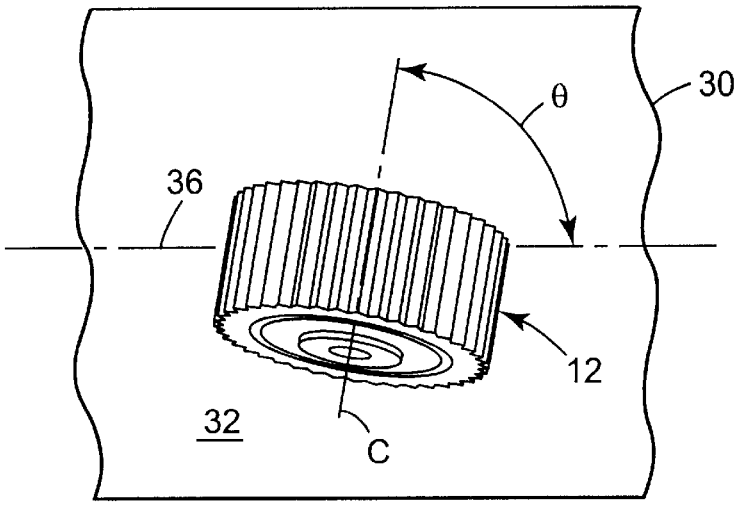
FIG. 11 is a view taken in direction 11—11 of the knurl wheel and workpiece of FIG. 10.

FIGS. 4–7 all illustrate the knurl mount 14 oriented such that the knurl wheel rotational axis C and mount longitudinal axis 20 lie in a plane that is perpendicular to longitudinal axis 36 of workpiece 30. Angle $\theta$ between the workpiece axis 36 and the plane of axis C and axis 20 is defined as 90° at such an orientation. When cylindrical workpiece 30 is oriented to have its longitudinal axis 36 horizontal, the-just described orientation of the knurl wheel puts wheel axis C and longitudinal axis 20 in a vertical plane. FIGS. 7–11 illustrate the orientation of the knurl wheel 12 relative to the workpiece 30, with the knurl mount 14 removed from the illustration for clarity. In FIGS. 8 and 9, the tool holder 10 has been adjusted to orient wheel 12 such that the plane defined by wheel axis C and mount longitudinal axis 20 is at an obtuse angle $\theta$ relative to workpiece axis 36. In FIGS. 10 and 11, tool holder 10 has been adjusted to orient the wheel 12 such that axis C and axis 20 lie in a plane that forms an acute angle $\theta$ relative to the axis 36 of the workpiece.

Figure 12:
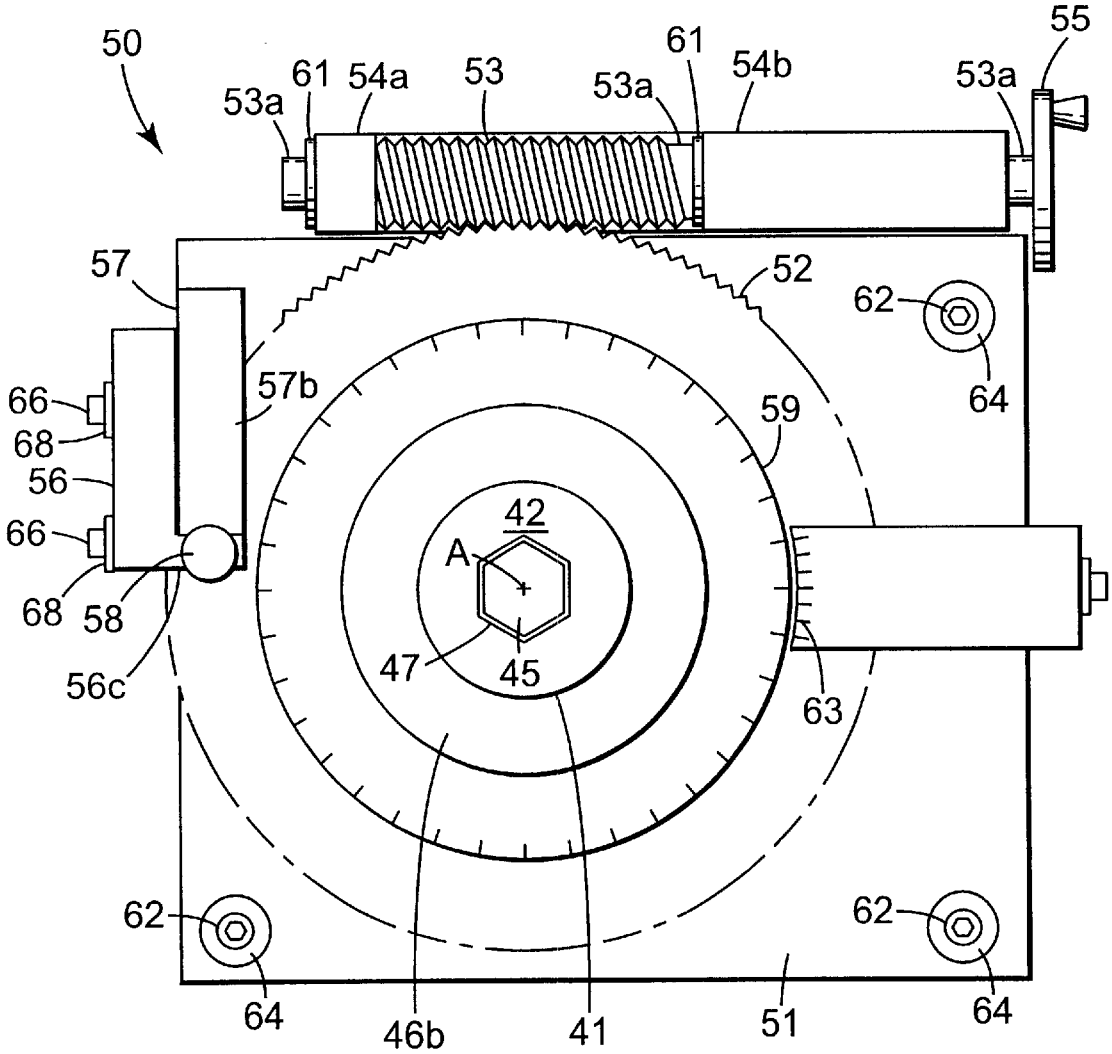
FIG. 12 is a rear elevational view taken in direction 12—12 of the rotational drive assembly portion of the tool holder of FIG. 1.

FIGS. 1, 12 and 13 illustrate the rotary drive assembly 50. Mounting plate 51 is bolted to the rear surface of the spindle 40 by bolts 62 and washers 64. The first end 42 of the shaft 41 has mounted thereon sleeve 46. Sleeve 46 includes a ring portion 46*a* affixed to the first end 42 of shaft 41, and a hollow cylindrical portion 46*b* extending rearwardly therefrom. Between ring portion 46*a* of the sleeve and the plate 51 is a clock spring 48 to bias the shaft 41 in one direction to help eliminate backlash.

Gear wheel 52 fits over the cylindrical portion 46*b* of sleeve 46 and adjacent to ring portion 46*a* of the sleeve 46, and is secured to the ring portion 46*a* such that rotation of the gear wheel causes the sleeve 46 and shaft 41 to rotate. Gear wheel 52 has a plurality of outwardly extending teeth. Mount 54 is attached to the top of mounting plate 51, such as by welding, and supports worm gear 53. On one end of worm gear 53, unthreaded shaft portion 53*a* is affixed to handle 55 to manually rotate the worm gear. Unthreaded portions 53*a* of the worm gear 53 are rotatably secured in holes through the rearward extending portions 54*a* of the mount 54. Worm gear 53 is engaged with the teeth on the gear wheel 52, such that rotation of the handle 55 causes the gear wheel to rotate, thereby rotating the shaft 41, knurl mount 14, and knurl wheel 12.

Secured to the rearward facing surface of the gear wheel 52 is a rotating calibrated scale 59. Secured to the mount plate 51 is a matching fixed position calibrated scale 60 (removed from FIG. 1 for clarity) that is adjacent to the rotating calibrated scale 59. Preferably, this arrangement has a 360° scale readable with a vernier scale to 6 minutes of arc.

A stopper mount 56 is attached to a side of the mounting plate 51, such as by welding. Plate portion 56*a* of the stopper mount extends rearward to the forward facing surface of the gear wheel 52. First arm portion 56*b* of the stopper mount extends rearward beyond the gear wheel 52. Second arm portion 56 of the stopper mount extends in front of and overlaps the rearward facing surface of the gear wheel 52. Set screw 58 is mounted in a threaded hole in the end of the second arm 56*c* of the stopper mount. A stopper member 57 is attached to the stopper mount 56, such as with bolts 66 and washers 68. Stopper member includes first portion 57*a* extending rearward beyond the gear wheel, and cantilevered arm portion 57*b* extending from the portion 57*a* adjacent to and overlapping the rear facing surface of the gear wheel 52. The cantilevered arm 57*b* is positioned such that its free end is between the set screw 58 and the face of the gear wheel 52. When the set screw is loosened and disengaged from the cantilevered arm, rotation of handle 55 and worm gear 53 causes the gear wheel 52 to rotate, thereby rotating shaft 41. When the shaft is at the desired rotational orientation, the set screw 58 can be tightened to press the cantilevered arm 57*b* against the face of the gear wheel, thereby minimizing the chance of unintended rotation of the shaft 41.

Bolt 45 extends through the shaft 41 for engagement with the threaded hole 29 in the knurl mount 14. After bolt 41 has been tightened into the knurl mount, locking nut 47 is tightened to pull the bolt and knurl mount rearward, to thereby securely seat the knurl mount 14 in the second end 43 of shaft 41.

The just-described preferred embodiment of the manual rotational drive assembly 50 can instead be any suitable manual or automatic positioning arrangement. For example, rotational drive assembly 50 could be a motor driven, high accuracy, computer controlled positioning system. Also, commercially available rotary indexing heads may be suitable for the knurl tool holder.

Knurling Tool

The above-described knurl tool holder may be advantageously used with any suitable knurl wheel 12, including conventional, commercially available cutting knurl wheels.

Figure 14:
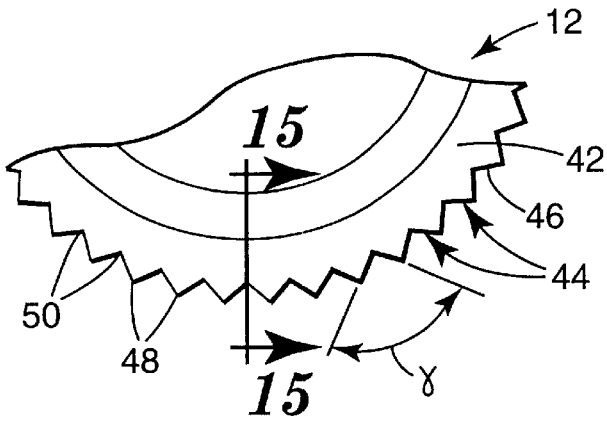
FIG. 14 is a partial elevational view of one embodiment of a knurling wheel according to the present invention.
Figure 15:
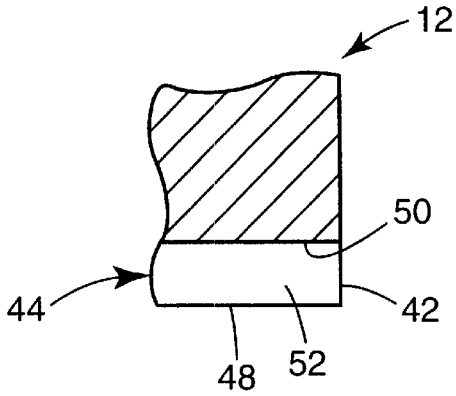
FIG. 15 is a partial sectional view taken along line 15—15 of the knurling wheel of FIG. 14.

One embodiment of a cut knurling wheel tool 12 is illustrated in FIGS. 14 and 15. Knurling wheel 12 has along its outer working surface a plurality of teeth 44. Each tooth 44 includes a tooth ridge 48 and first and second side surfaces 52. A valley 50 bounded by one side surface 52 from each adjacent tooth 44 is located between each pair of adjacent teeth 44. Each wheel 12 also includes major opposed surfaces 42 (only one illustrated). Where the side surfaces 52 of the teeth 44 meet the major surface 42, an edge 46 is formed. For cut knurling, it is preferred that the major surface 42 of the knurling wheel has an undercut 54. Undercut 54 is illustrated as an arcuate surface extending around the full circumference of wheel 12. The undercut provides an improved rake angle when the knurling wheel is engaged with the outer surface of the workpiece. Alternatively, undercut 54 can be flat or any other configuration to provide a zero or positive rake angle. The undercut 54 preferably extends to ridge 48 in one direction, and extends far enough inward from ridge 48 to improve the cutting characteristics of edge 46 and major surface 42, preferably at least as far as tooth valley 50. A positive rake angle provides more efficient cutting than a zero or negative rake angle, and also reduces the amount of burring of the workpiece.

The inventive knurl tool holder 10 described herein is particularly well suited for use with knurl wheels having teeth of different configuration within a single knurl wheel. Knurl tool holder 10 can orient the knurling wheel 12 at infinitely variable angular orientations, while maintaining the forward most point of the knurl wheel located at the same position. This allows use of knurl wheels 12 that have a plurality of tooth configurations on a single knurl wheel. The variation of tooth configuration can be in tooth height, tooth width, tooth shape, spacing between adjacent teeth, use of non-symmetrical teeth, or any other desired parameter.

The tooth configuration may vary completely around the circumference of the wheel, that is no two teeth being identical. Alternatively, a "sequence" of a number of teeth having different configurations within the sequence may repeat an integer number of times "N" around the knurl wheel circumference. If the tooth at the beginning of each such repetitive sequence is designated as "tooth 1" and the groove in the workpiece cut by that tooth is designated as "groove 1," it can be seen that a clean pattern of grooves in various configurations corresponding to the tooth configurations will be generated if during knurling a "tooth 1" always enters a "groove 1."

Figure 14A:
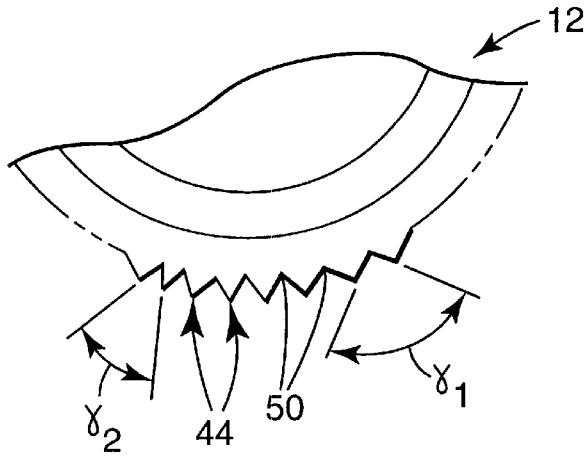
FIG. 14A is a partial elevational view of an alternate embodiment of a knurling wheel according to the present invention.

One preferred knurling wheel illustrated in FIG. 14A, has its tooth configuration varied by cutting different angles $\gamma_1$, $\gamma_2$, $\gamma_3$, . . . $\gamma_N$ of the valley 50 between teeth 44 on the knurl wheel 12. At least some of the teeth 44 are preferably asymmetric. For example, a wheel tooth formed between adjacent 90° and 70° valleys would be asymmetric. The peak angles of the ridges formed on the workpiece between grooves are nearly equal to the "valley" angles $\gamma$ between the teeth on the knurling wheel.

While the knurling teeth 44 are illustrated herein as forming a ridge at 48 and a valley at 50, knurling teeth of other profiles can be advantageously used with the present invention. For example, rather than coming to a line or edge at ridge 48 and valley 50, the ridge 48 or valley 50 can instead comprise a flat surface, rounded surface, or other contour. Also, teeth side surfaces 52 can be curved or other profiles rather than planar. These alternate tooth configurations are better suited for use with cut knurling rather than form knurling, although certain configurations may be used under some conditions with form knurling.

The knurling wheel should be a material that is strong enough to resist chipping and breaking during use, and that maintains a sufficiently sharp cutting edge during use. Suitable knurling wheels have been made of tool steel and tungsten carbide, with tungsten carbide having improved wear resistance. Wear resistant coating such as TiN, TiCN, and CrN may be useful.

EXAMPLE 1

One example of a knurling wheel 12 was made as follows. A plurality of triangular teeth were cut into a round wheel having an initial diameter of 3.2334 cm (1.273 inches) using conventional wire EDM procedures. The diameter of the wire used to cut the teeth was 30 micrometers (0.0012 inch). The teeth were in a pseudo-random sequence of varying teeth sizes. The sequence repeated each quarter (90°) of the wheel, i.e., the pattern repeated 4 times around the wheel. The knurling wheel was made of tungsten carbide type CD-636.

The table below summarizes the details for the pseudo-random pattern of teeth. The pattern consisted of forty-four teeth, each 0.0356 cm (0.014 inch) high measured radially from the base of the tooth to the tip. The configuration of the teeth is defined with reference to the angle and width of the "valleys" cut in the knurling wheel. The "Angle" reported in the table is the angle of the valley cut into the wheel by the wire EDM. The "Width" reported in the table is the circumferential tip-to-tip distance between adjacent teeth, measured at the respective center of each tooth.

TABLE 1

| Valley Number | Angle degrees | Width micrometers (inches) |
|---|---|---|
| 1 | 90 | 71.628 (0.0282) |
| 2 | 70 | 51.054 (0.0201) |
| 3 | 80 | 60.706 (0.0239) |
| 4 | 70 | 51.054 (0.0201) |
| 5 | 90 | 71.628 (0.0282) |
| 6 | 70 | 51.054 (0.0201) |
| 7 | 80 | 60.706 (0.0239) |
| 8 | 90 | 71.628 (0.0282) |
| 9 | 70 | 51.054 (0.0201) |
| 10 | 90 | 71.628 (0.0282) |
| 11 | 70 | 51.054 (0.0201) |
| 12 | 80 | 60.706 (0.0239) |
| 13 | 60 | 42.672 (0.0168) |
| 14 | 80 | 60.706 (0.0239) |
| 15 | 60 | 42.672 (0.0168) |
| 16 | 70 | 51.054 (0.0201) |
| 17 | 60 | 42.672 (0.0168) |
| 18 | 80 | 60.706 (0.0239) |
| 19 | 70 | 51.054 (0.0201) |
| 20 | 60 | 42.672 (0.0168) |
| 21 | 70 | 51.054 (0.0201) |
| 22 | 80 | 60.706 (0.0239) |
| 23 | 70 | 51.054 (0.0201) |
| 24 | 60 | 42.672 (0.0168) |
| 25 | 70 | 51.054 (0.0201) |
| 26 | 80 | 60.706 (0.0239) |
| 27 | 60 | 42.672 (0.0168) |
| 28 | 70 | 51.054 (0.0201) |
| 29 | 60 | 42.672 (0.0168) |
| 30 | 80 | 60.706 (0.0239) |
| 31 | 60 | 42.672 (0.0168) |
| 32 | 80 | 60.706 (0.0239) |
| 33 | 70 | 51.054 (0.0201) |
| 34 | 90 | 71.628 (0.0282) |
| 35 | 70 | 51.054 (0.0201) |
| 36 | 90 | 71.628 (0.0282) |
| 37 | 80 | 60.706 (0.0239) |

TABLE 1-continued

| Valley Number | Angle degrees | Width micrometers (inches) |
|---|---|---|
| 38 | 70 | 51.054 (0.0201) |
| 39 | 90 | 71.628 (0.0282) |
| 40 | 70 | 51.054 (0.0201) |
| 41 | 80 | 60.706 (0.0239) |
| 42 | 70 | 51.054 (0.0201) |
| 43 | 90 | 71.628 (0.0282) |
| 44 | 90 | 71.628 (0.0282) |

The knurl wheel teeth of Example 1 are frequently asymmetrical. For example, the wheel tooth formed between adjacent 90° and 70° valleys would have a half angle on the 90° groove side of 43.73° and a half angle on the 70° groove side of 34.10° (these half angles are not simply 45° and 35°, respectively, because of the curvature of the wheel). The peak angles of the ridges formed on the workpiece between grooves are nearly equal to the "valley" angles between the teeth on the knurling wheel.

Method of Knurling

Figure 17:
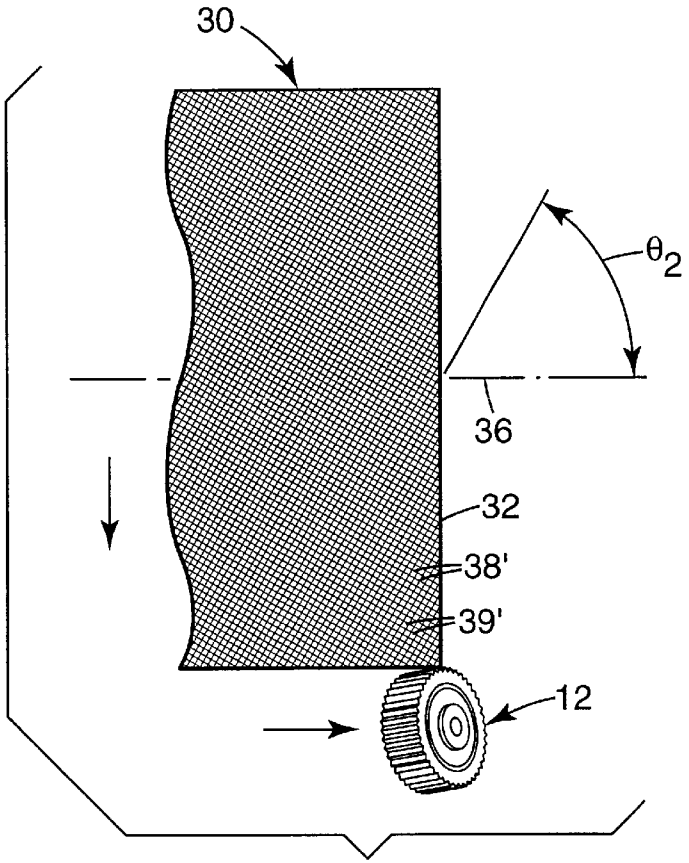
FIG. 17 is a view like FIG. 15, showing a second step of the method according to the present invention.
Figure 16:
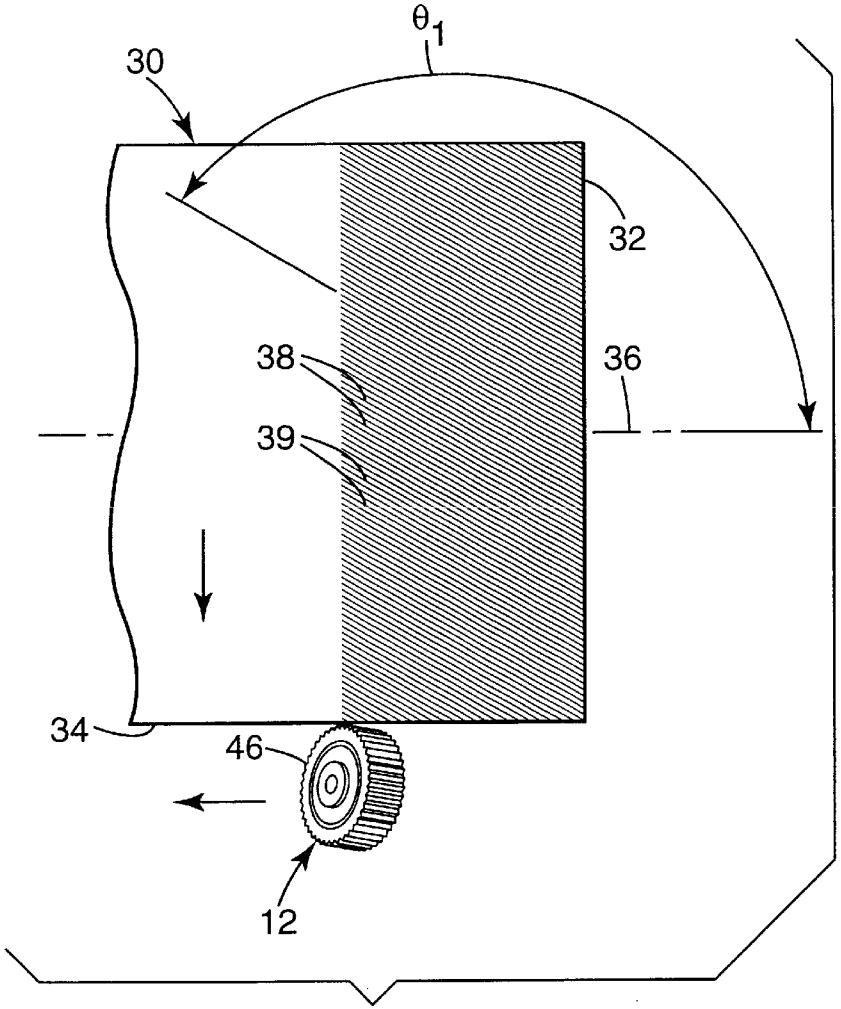
FIG. 16 is a partially schematic top view illustrating one step of a method for knurling a workpiece according to the present invention.

A preferred method of knurling a workpiece is illustrated in FIGS. 16 and 17, in which the tool holder 10 has been removed to more clearly illustrate the position of knurl wheel 12 with respect to the workpiece 30. FIGS. 16 and 17 are both top plan views of the workpiece 36 and knurl wheel 12. A first plurality of grooves 38 having peaks 39 are initially cut. The tool holder 10 is set to orient the plane defined by knurl wheel axis C and knurl mount axis 20 at an obtuse angle θ. The tool holder is positioned such that axis A intersects and is perpendicular to the longitudinal axis 36 of the workpiece. The cutting knurl wheel 12 is engaged to a desired depth of cut into the workpiece surface 34 as the workpiece is rotated in the direction shown, and the knurl wheel is traversed in the direction shown. This first plurality of grooves 38 will have a first helix angle $\theta_1$, and the respective groove cross-sections will generally correspond to the shape of the valley 50 between teeth 44 on the knurl wheel.

The lathe is then stopped, and the tool holder is set to orient the plane defined by axis C and axis 20 to an acute angle θ relative to the workpiece axis 36. The cutting knurl wheel 12 is engaged to a desired depth of cut into the workpiece surface 34 as the workpiece is rotated in the direction shown, and the knurl wheel is traversed in the direction shown. This second plurality of grooves 38' having peaks 39' will have a second helix angle $\theta_2$, opposite to $\theta_1$. The respective groove cross-sections will generally correspond to the shape of the valley 50 between teeth 44 on the knurl wheel. A plurality of pyramids will be formed by the intersection of the first and second pluralities of grooves.

Helix angles $\theta_1$ and $\theta_2$ may be equal and opposite, in which case the pyramidal pattern will be aligned along the circumferential direction of the workpiece. Alternatively the helix angles $\theta_1$ and $\theta_2$ may be unequal magnitude and opposite sign, in which case the pyramidal patter will not be aligned in the circumferential direction of the workpiece. Further details on selecting $\theta_1$ and $\theta_2$ so as to provide a desired orientation of the pyramidal pattern are found in WIPO International Patent Application Publication Number WO 97/12727, published on Apr. 10, 1997, "Method and Apparatus for Knurling a Workpiece, Method of Molding an Article With Such Workpiece, and Such Molded Article," Hoopman et al., the entire disclosure of which is incorporated herein.

If desired, optional clean up cuts may be repeated in the existing grooves to provide additional depth of cut, or to clean up the profile of the grooves.

With the knurl tool holder 10 disclosed herein, the synchronization of the knurl tooth sequence with the generated structure on the workpiece is achieved by helical angle adjustments. For example, it may be desired to knurl a workpiece 30 of diameter "D" with a knurl wheel 12 of diameter "d" having a varying tooth form sequence that repeats "N" times around the circumference of the knurling wheel 12. If the knurl wheel 12 is positioned by the holder 10 such that the knurl wheel rotational axis C is at 90° to the longitudinal axis 36 of the workpiece, the workpiece imparts no rotational motion to the knurl wheel. As the holder 10 is moved axially along the surface of the workpiece, a pattern of circumferential grooves will be generated with the sequence of teeth repeating at an axial distance of:

$$(\pi \times d) \not\partial N.$$

When the axis C of the knurl wheel 12 is positioned parallel or 0° to the workpiece axis 36, the knurl wheel 12 is driven by the roll in pure rotation at a rotational speed that is D/d times the workpiece rotational speed. Between the 0° and 90° knurl axis positions there are various angular positions θ at which the value of:

$$(D \times N \times \text{Cosine}(\theta)) \not\partial d$$

is an integer. Near these theoretical positions the knurl wheel sequence will properly align with an integer number of repeats such that a tooth 1 of one of the sequences of teeth will align in a groove 1 in the sequence of grooves being generated in the surface of the workpiece.

Table 2 presents the value of θ to provide the desired amount of repeats of the sequence of teeth. This is calculated for a workpiece having a diameter of 8.0545 inches, and knurl wheel having a diameter of 1.272 inches, and for knurl wheels having one, two, and four repeats of teeth sequences.

TABLE 2

| Repeats | Angle θ |
|---|---|
| Wheel A One Sequence | |
| 6 | 18.51 |
| 5 | 37.79 |
| 4 | 50.79 |
| 3 | 61.70 |
| 2 | 71.57 |
| 1 | 80.91 |
| Wheel B Two Sequences | |
| 12 | 18.51 |
| 11 | 29.63 |
| 10 | 37.79 |
| 9 | 44.67 |
| 8 | 50.79 |
| 7 | 56.42 |
| 6 | 61.70 |
| 5 | 66.73 |
| 4 | 71.57 |
| 3 | 76.29 |
| 2 | 80.91 |
| 1 | 85.47 |
| Wheel C Four Sequences | |
| 25 | 8.96 |
| 24 | 18.51 |
| 23 | 24.66 |
| 22 | 29.63 |
| 21 | 33.93 |

TABLE 2-continued

| Repeats | Angle θ |
|---|---|
| 20 | 37.79 |
| 19 | 41.35 |
| 18 | 44.67 |
| 17 | 47.80 |
| 16 | 50.79 |
| 15 | 53.65 |
| 14 | 56.42 |
| 13 | 59.09 |
| 12 | 61.70 |
| 11 | 64.24 |
| 10 | 66.73 |
| 9 | 69.17 |
| 8 | 71.57 |
| 7 | 73.94 |
| 6 | 76.29 |
| 5 | 78.61 |
| 4 | 80.91 |
| 3 | 83.19 |
| 2 | 85.47 |
| 1 | 87.74 |

Figure 18:
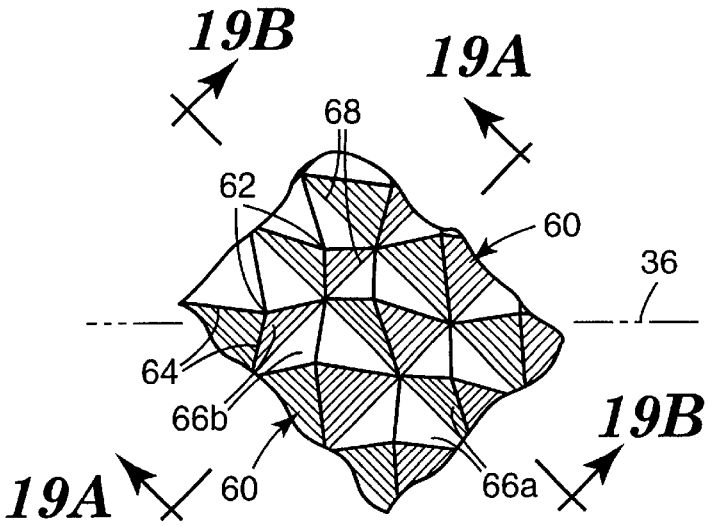
FIG. 18 is a plan view of the pattern imparted on the workpiece by the apparatus and method of the present invention.
Figure 19A:
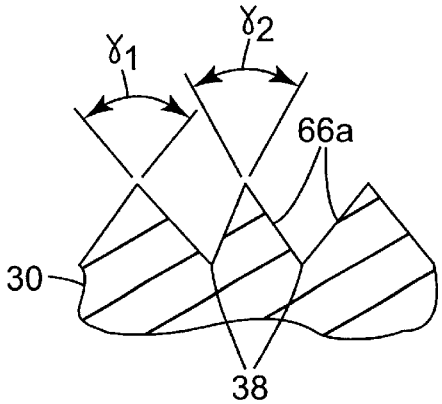
FIG. 19A is a partial cross-sectional view taken along line 19A—19A of the workpiece of FIG. 18.
Figure 19B:
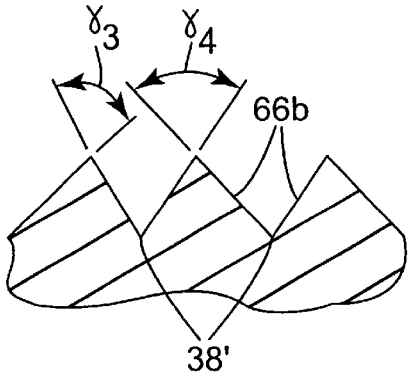
FIG. 19B is a partial cross-sectional view taken along line 19B—19B of the workpiece of FIG. 18.

The knurl pattern formed by the just-described method and apparatus is illustrated in FIG. 18. The knurl pattern comprises a plurality of pyramids 60 projecting from the workpiece 30. The pyramids each comprise peak 62, side edges 64 extending from the peak, base edges 68, and sides surfaces 66 bounded by the side edges and base edges. A cross section of the pyramids 60 is illustrated in FIGS. 19A and 19B. As seen in FIGS. 18 and 19A, the first plurality of grooves 38 have groove sides 66*a*. As seen in FIGS. 18 and 19B, second plurality of grooves 38' have groove sides 66*b*. The intersection of the two sets of grooves thus forms the pyramids 60. Each pyramid has a pair of opposed sides 66*a* formed by adjacent first grooves and a pair of opposed sides 66*b* formed by adjacent second grooves. It is seen that the pyramids remaining between the intersecting grooves cut by the knurling teeth 41 have an angle $\gamma_N$ that will be substantially equal to the valley angle $\gamma_N$ between the knurling teeth for a small value of clearance angle β.

The knurl pattern is illustrated herein as having pyramidal peaks which come to a point at 62 formed by the intersection of peaks 39 and 39'. This occurs when the cutting wheel teeth 44 are engaged to their full depth into the workpiece, engaging the workpiece to their full extent at edge 46 from ridge 48 to valley 50. Other patterns are also attainable with the present invention. For example, truncated pyramids, that is pyramids with flat tops rather than pointed peaks 62, can be made by engaging the knurling teeth 44 for only a portion of their depth. By engaging the teeth 44 to a partial depth, the edge 46 will not engage all the way up to tooth valley 50. This will leave a portion of outer surface 34 of workpiece 30 in its original, unknurled condition, providing a truncated top to the pyramids 60. It is also possible to use teeth 44 configured to have flat or curved spaces between the teeth 44 at valley 50, or a flat or other configuration at 48 rather than an edge ridge.

One preferred method of knurling a workpiece according to the present invention will be described with respect to the following example.

EXAMPLE 2

The workpiece, a steel roll with a 20.32 cm (8 inch) diameter and a 91.4 cm (36 inch) length, was plated with 0.127 cm (0.050 inches) of copper having a hardness of 210 to 230 Vickers. The roll was mounted in a Lodge & Shipley lathe and faced off to a diameter of 20.562±0.0005 cm (8.0952±0.0002 inches). Shoulders, 0.2794 mm (0.0110 in) deep, 3.81 cm (1.5 inch) wide were then cut into the workpiece surface at each end, with a 1:10 taper ramp up to the outer diameter of the roll.

A knurl tool holder 10 as described with respect to the preferred embodiment above, was installed on the cross slide of the lathe. Axis A of the tool holder 10 intersected with and was perpendicular to the longitudinal axis 36 of the workpiece. A knurl mount 14 having the axis C for the mounting wheel at an angle α of 85° was mounted on the second side 43 of the shaft 41. A dial indicator was used to set the plane defined by knurl wheel axis C and knurl mount axis 20 to vertical. The angle on vernier scale 59, 60 at this orientation read 280° 36'. In the remaining description, this orientation will be deemed to be an angle θ of 90 degrees. If the tool holder 10 were adjusted to rotate the knurl mount 14 clockwise (as viewed from the rear side of the tool holder 10 facing the workpiece) by 90 degrees such that the plane defined by axis C and axis 20 is horizontal, the vernier would read 190° 36'. In the remaining discussion, such an orientation will be deemed to be and angle θ of zero degrees. Positive angles are counterclockwise as viewed from the rear of the tool holder 10 looking toward the workpiece.

The knurling wheel 12 of Example 1 was mounted in the knurl mount 14. Three adjacent 90° valleys at the end of each of the four sequences of teeth provided a way to index the rotation of the knurl wheel. The location of the sequence was further facilitated by applying a small ink dots to the knurl wheel to mark the location of the center one of the three 90° valleys in each of the four sequences around the circumference.

It was necessary to adjust the angular orientation of the tool mount 10, and thereby adjust the angle of the knurl wheel axis of rotation C, to provide an integer number of repeats of the one-quarter circumference, 44 tooth sequence, in the knurling wheel 12 around the circumference of the roll. The angle θ required to obtain exact pattern match between "tooth 1" on the wheel and "groove 1" on the surface of the roll was determined in an iterative process as follows. Because the circumference of knurl wheel 12 was 10.16 cm (4.0 inches), the circumferential length of one sequence was 2.54 cm (1.0 inch).

The first direction of cut was intended to produce 21 repeats of the 44 tooth sequence around the circumference of the roll with teeth having a height of 0.036 cm (0.014 inch). The intended depth of cut of the teeth was 0.033 cm (0.013 in). The tips of the teeth would therefore be at a roll diameter D of:

$$20.562-(2\times0.033)=20.492\ cm$$

$$(8.095-(2\times0.013)=8.069\ \text{inch}).$$

The length of the repeating sequence as measured along the circumferential direction of the roll face, at the desired cutting depth, to provide 21 repeats along the circumference was $$\frac{8.069\pi}{21}=1.207\ \text{inches}$$

The length of the repeat was adjusted by changing the angle of the knurl wheel relative to the axis of the roll face being cut. If the knurl wheel were left at θ of zero (axis C parallel to the axis of the roll), the knurl wheel would emboss a pattern in the roll face identical to that of the knurl wheel. The repeat would be 1.0 inch, the circumferential length of one sequence on the knurl wheel 12. If the axis C of the knurl wheel was set to θ of 90°, the knurl wheel would not rotate, so the repeat distance would be infinite. For a knurl wheel traveling parallel to the longitudinal axis of the roll from the tailstock toward the headstock of the lathe, the knurl wheel angle, θ required to produce intermediate repeat distances can be estimated by $$\theta = \sin^{-1}\left(\frac{K}{R}\right) + 90°$$

Where K is the repeat distance of the knurl wheel and R is the repeat distance of the circumference of the roll face. Here, where K=1.0 inch and R=1.207 inches, then θ=145° 56'. Thus, the tool holder was be adjusted so that axis C of the cutting wheel is at θ=145° 56'.

The knurl wheel 12 was then moved to about 0.3175 cm (⅛") from the outer edge of the shoulder previously cut on the tailstock end of the roll face. The lathe carriage was set to feed 0.0635 cm/revolution (0.0025 inch/revolution) and engaged the feed. The workpiece was rotated by hand until the carriage actually began to feed toward the headstock. With the lathe stopped, the cross slide was slowly hand fed until the knurl wheel touched the work piece surface and then was fed in an additional 0.0051 cm (0.002 inch).

The workpiece was rotated just short of one revolution to cut a single row of grooves 0.0051 cm (0.002 inch) deep in the surface of the workpiece. The pattern of the grooves was visually examined with a hand held 4X magnifying glass. To determine the start and end of the 44 tooth sequence, the three adjacent equally spaced grooves in the workpiece (created by the three adjacent teeth corresponding to the three 90° valleys in the knurling wheel) where located, and the center of these three grooves was marked with a pencil. This was repeated for three successive tooth sequences. Next, a broad tipped marker was used to blacken the row of grooves in the area where the groove sequences were marked. Then, the workpiece was rotated by hand an additional 360° so that a second row of grooves was cut circumferentialy superimposed, but 0.0064 cm (0.0025") to the left of the first row of grooves. The pattern created by the three 90° valleys on the second row was located and marked with a pencil. This second set of grooves was easy to pick out because it was freshly cut and not blackened. Comparison to the location of the marks on the first and second rows of grooves showed that the sequence of grooves was about 2 grooves too long to give a pattern match.

The knurling wheel was backed out from the workpiece and the carriage moved about 0.3175 cm (⅛") past the previously cut area to a virgin area of the workpiece. The tool angle θ was increased by 0° 12' and the above procedure repeated. The groove pattern was observed to be about 1 groove too long. The tool holder angle θ was increased an additional 0° 12', and the above procedure was repeated. The groove pattern was observed to be about ¾ of a groove too short for pattern match.

The lathe speed was set to 100 rpm and power was applied. The lathe was stopped after feeding about 0.6350 cm (¼") without disengaging the carriage feed. Examination of the cut area showed cleanly cut grooves with exactly 21 repeats of the 44 tooth, one-quarter knurling wheel sequence. The lathe was restarted and cutting continued until it had fed about 0.6350 cm (¼") past the ramp of the shoulder area. After stopping the lathe, examination of the groove structure with a roll microscope showed that the cut was at full depth as indicated by the lack of a flat on the top of the ridges between the grooves. Cutting was continued for about another 2.54 cm (one inch) across the face of the roll before stopping again.

The groove structure continued to look good in spite of two missing tooth faces which had chipped away. The odd number of repeats (21) meant that the corresponding teeth in each of the four repeating sequences in the knurling wheel combined to cut a single groove. That is, each particular "groove 1" in the workpiece surface was engaged sequentially by a "tooth 1" from each of the four repeating knurl wheel sequences. This helps overcome any defect that might have resulted from a missing or broken tooth.

The lathe was restarted and the cut continued until it was about 1.27 cm (½") short of reaching the shoulder on the headstock end of the roll. The groove structure on the roll still appeared acceptable. At this point, the knurl wheel had 22 damaged teeth, but only the two teeth that were observed to be severely chipped earlier were missing completely. Average groove depth at the tailstock end was 0.0318 cm (0.0126 inch). The average groove depth at the middle and headstock end of the roll was 0.0315 cm (0.0124 inch) indicating only minor knurl wheel wear. The workpiece surface now had a first plurality of parallel grooves 38 with ridges 39 oriented at a first helix angle $\theta_1$ as illustrated in FIG. 16.

The knurl mount 14 was removed, the knurl wheel 12 was removed and reinserted with the opposite major surface facing up to expose a fresh cutting surface, and then the knurl mount was reinstalled. When the plane defined by knurl wheel axis C and knurl mount axis 20 was vertical, the vernier angle now read 280° 48', indicating that the defined zero tool angle had shifted to a vernier reading of 190° 48'. This vernier reading will now be deemed to be θ of 0°

A second plurality of grooves 38' having ridges 39' oriented at a second helix angle of $\theta_2$ in opposite direction to $\theta_1$ was formed by cutting a pattern of 15 repeats of the 44 tooth sequence in the roll face starting at the headstock end. The repeat distance of 15 sequences in the circumferential direction of the workpiece was $$\frac{8.069\pi}{15} = 1.690 \text{ inches}$$

For a knurl wheel moving from the headstock to the tailstock the knurl wheel axis angle θ is given by $$\theta = \cos^{-1}\left(\frac{K}{R}\right)$$

For K=1.0 inches and R=1.69 inches, θ=53° 43'.

Because the previous estimate was too low, a similar error would be expected to make this estimate to be too high. The tool holder 10 was set to θ of 53° 12' and the carriage was set to feed 0.0064 cm/revolution (0.0025 inch/revolution) from the headstock to the tailstock and the same groove pattern match procedure described earlier was used. The groove pattern was 4½ teeth short. The procedure was repeated with the tool angle θ increased by 0° 30'. The pattern was observed to be about 2½ teeth too long. Tool angle was reduced by 0° 12' which resulted in a pattern match about 1 tooth short. The lathe was run at 100 rpm for about ¼" of cutting, but the knurl wheel tooth sequence did not align into the workpiece surface groove sequence. Rather it left a gnarly, chewed up surface. The tool was again moved to fresh surface and the tool angle increased by 0° 06'. The sequence match was observed to be about 1 tooth long. The lathe was started and again cut about ¼" of pattern, but the sequence would not align. Again, the knurl wheel holder was moved to a new area on the workpiece and reduced by 0° 03'. The pattern match was observed to be about 1 tooth too long. After a short powered run, the sequence did not align. The depth of cut was decreased about 0.0005 under the theory that the slightly larger roll diameter for the knurl teeth (and thus increased pattern length) would allow the sequence to align. However, sequence alignment was not achieved. At this point, there was no remaining uncut surface on the shoulder on which to attempt more starts.

The knurling wheel was backed out and moved to a fresh start area on the full diameter area of the roll. The vernier reading was left at its current setting. The lathe was started and the knurling wheel slowly fed into the surface of the roll as the carriage fed toward the tailstock. A short time after target depth was achieved, it was apparent that the sequence aligned. A check of the depth of the grooves showed that they were 0.0005 too deep to match the grooves cut in the first pass. Depth of cut was decreased by 0.0005 and cutting continued until about ¾" of cross-cut pattern had been cut. Depth match was within 0.0001. There was some burring on the pyramids formed by the intersecting grooves as the knurl teeth broke into the first plurality of grooves, but the pyramid edges were burr-free on the opposite edges formed when the knurl wheel entered a ridge to cut the next pyramid. The knurl wheel was examined for damage. Only two teeth were chipped.

Cutting of the second plurality of grooves was continued until the cross-cut pattern was about 0.127 cm (½") short of the shoulder area of the tailstock end. Examination of the roll showed that the second cut was 0.0005 cm (0.0002 inch) deeper than the first cut at the tailstock end. Second plurality of grooves 38' having peaks 39' intersected the first plurality of grooves. Pyramids covered the roll surface in the cross-cut area.

Next, light cuts with the same knurling wheel were made in the first set plurality of grooves to reduce the burrs on the edges of the pyramids. This second pass on the first plurality of grooves began at the tailstock end in the ½" band of single direction grooves that were cut in the first pass. The carriage feed was engaged to feed from the tailstock to the headstock and the workpiece rotated by hand until the carriage started to move in that direction. The three 90° teeth were lined up with the set of grooves they had cut in the first pass direction and the knurl wheel was fed in to the same depth as used for the first pass. A 4X magnifying glass was used to check that the knurl wheel was indexed properly as the workpiece was slowly rotated by hand. The lathe was started and about 0.9525 cm (⅜") of pattern was re-cut. Two depth checks were made 90° apart on the roll face. One showed the depth of cut was 0.0025 cm (0.0010 inch) too deep and the second 0.0038 cm (0.0015 inch) too deep. There was now significant burring in the second plurality of grooves. Depth of cut was reduced by 0.0025 cm (0.0010 inch). After cutting another 0.6350 cm (¼" inch), burring was significantly reduced but depth of cut still measured 0.0025 cm (0.0010 inch) too deep. The knurl wheel was backed out another 0.0019 cm (0.00075 inch) and now the cut measured 0.0020 cm (0.0008 inch) too deep. The knurl wheel was backed out an additional 0.0019 cm (0.00075 inch), but this depth of cut was too shallow and burrs remained in the first pass grooves. Depth of cut was increased 0.0013 cm (0.0005 inch) and after a short run, burrs were observed to be in the second plurality of grooves, but a previous slightly deeper cut had less overall burring. The depth of cut was again increased by 0.0013 cm (0.0005 inch). After a short run, some of the grooves were burr free in both directions and other areas showed only light burrs in the second plurality of grooves.

The lathe was restarted and the remaining cross-cut face was re-cut at that depth. After the re-cut was completed, the roll was examined with a rollscope at 100X. Some peaks had no burrs whereas others had burrs on one edge only. The depth match looked excellent.

The tool angle was re-set for a cleanup pass in the second plurality of grooves. The same procedure that was used for the cleanup in the first plurality of grooves was used to index the knurling wheel to the existing second plurality of grooves. Depth of cut was again adjusted by observing the size and location of burrs left by the knurl wheel. After adjustment for optimum depth, the second plurality of grooves were re-cut. The resulting roll showed depth match of better than 0.0005 cm (0.0002 inch) and bright rounded tips on the pyramids.

Next, the roll surface was brushed with kerosene to remove remaining loose burrs. The kerosene was manually applied with a soft brass brush to the surface of the slowly spinning roll. The kerosene was then removed from the roll with a towel, and initially, numerous metal chips were collected on the towel. Brushing was continued until very few metal chips appeared on the towel.

The surface of the roll was then plated with a 3 to 5 micrometer thick layer of electroless nickel. The electroless nickel provided corrosion protection and improved release of polymeric material from the roll surface.

After being plated, the roll was used for embossing polypropylene film for use in structured abrasive manufacture.

Molded Article

Figure 20:
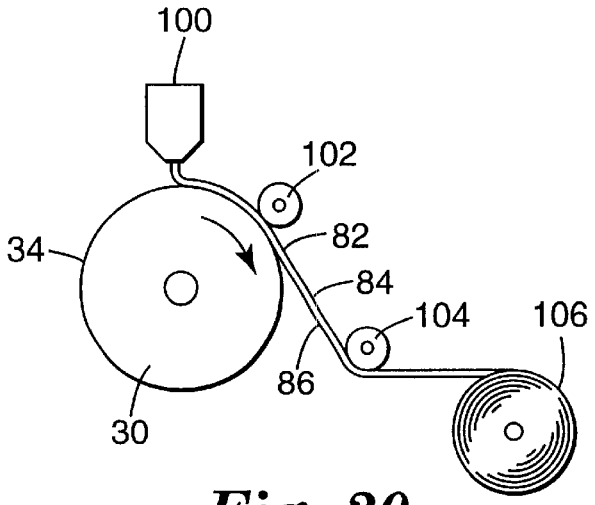
FIG. 20 is a partially schematic view of an apparatus and method for making a production tool according to the present invention.
Figure 21:
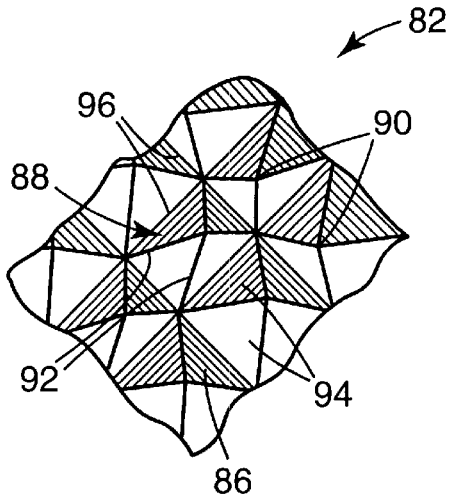
FIG. 21 is a plan view of the production tool of FIG. 20.

One preferred method of using workpiece, or master tool, 30 to fabricate a molded article such as a production tool, is illustrated in FIG. 20. The production tool 82 is fabricated by extruding at station 100 a moldable material, preferably a thermoplastic material, onto the knurled outer surface 34 of master tool 30. The thermoplastic material is forced against surface 34 at nip 102. Production tool 82 is then peeled away from the master tool 30 and wound onto mandrel 106. In this manner, a production tool 82 of any desired length may be obtained. The molding surface 86 will have the inverse of the pattern on the knurled outer surface 34 of master tool 30. When the pattern imparted on outer surface 34 of master tool 30 is a positive of the pattern of the ultimate fabricated structured abrasive article (or other article as desired), the pattern on mold surface 86 will be the inverse of the pattern of the ultimate article. As seen in FIG. 21, the production tool mold surface 86 comprises a plurality of pyramidal pockets 88 which are the inverse of the pyramids 60 on master tool 30. Pyramidal pockets include bottom point 90, side edges 92, side surfaces 94, and upper edges 96. Back surface 84 is relatively flat and smooth. It may be desired that production tool 82 is the ultimate fabricated article, in which case the pattern on the outer surface 34 of master tool 30 will be the negative or inverse of the desired ultimate pattern on production tool 82.

Thermoplastic materials that can be used to construct the production tool 82 include polyesters, polycarbonates, poly (ether sulfone), polyethylene, polypropylene, poly(methyl methacrylate), polyurethanes, polyamides, polyvinylchloride, polyolefins, polystyrene, or combinations thereof. Thermoplastic materials can include additives such as plasticizers, free radical scavengers or stabilizers, thermal stabilizers, antioxidants, ultraviolet radiation absorbers, dyes, pigments, and other processing aides. These materials are preferably substantially transparent to ultraviolet and visible radiation.

Because the workpiece, or master tool, 30 has a continuous, uninterrupted knurled pattern around its circumference, a production tool of any desired length in direction D may be economically molded without seams or interruptions on the molding pattern. This will allow for the production of structured abrasive articles of any length with an uninterrupted structured abrasive composite pattern. Such structured abrasive articles will be less likely to shell or delaminate than other structured abrasive articles which have a seam or interruption in the pattern due to seams in the production tool.

The production tool 82 can also be formed by embossing a moldable material with the knurled master tool 30. This can be done at the required force and temperature so as to impart the mold surface 86 of the production tool with the inverse of the knurl pattern on the workpiece. Such a process can be used with single layer or multiple layer production tools 82. For example, in a multiple layer production tool, the mold surface 86 can comprise a material suitable to be molded into the desired pattern, while the back surface 84 can comprise a suitably strong or durable material for the conditions to which the production tool 82 will be subjected to in use.

The production tool 82 can also be made of a cured thermosetting resin. A production tool made of thermosetting material can be made according to the following procedure. An uncured thermosetting resin is applied to a master tool 30. While the uncured resin is on the surface of the master tool, it can be cured or polymerized by heating such that it will set to have the inverse shape of the pattern of the surface of the master tool. Then, the cured thermosetting resin is removed from the surface of the master tool. The production tool can be made of a cured radiation curable resin, such as, for example acrylated urethane oligomers. Radiation cured production tools are made in the same manner as production tools made of thermosetting resin, with the exception that curing is conducted by means of exposure to radiation, e.g. ultraviolet radiation.

While the inventive methods and apparatuses described herein are particularly well suited for use in manufacturing structured abrasives, the present invention is not thereby limited. For example, the inventive knurling methods and apparatuses described herein may be used on a workpiece 30 that is the ultimate manufactured article having its own use, rather than a master tool to be used in subsequent processes. Additionally, when the workpiece is a master tool, its use is not limited to making a production tool for use in subsequent processes. That is, the molded article which is molded with the knurled workpiece may be the ultimate manufactured article having its own use. Furthermore, the knurled workpiece 30 can be used as a rotogravure coater for making abrasive or other articles.

Method of Making a Structured Abrasive Article

The first step to make the abrasive coating is to prepare the abrasive slurry. The abrasive slurry is made by combining together by any suitable mixing technique the binder precursor, the abrasive particles and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles are gradually added into the binder precursor. The amount of air bubbles in the abrasive slurry can be minimized by pulling a vacuum during the mixing step. In some instances it is preferred to heat the abrasive slurry to a temperature to lower its viscosity as desired. For example, the slurry can be heated to approximately 30° C. to 70° C. However, the temperature of the slurry should be selected so as not to deleteriously affect the substrate to which it is applied. It is important that the abrasive slurry have a rheology that coats well and in which the abrasive particles and other fillers do not settle.

There are two main methods of making the abrasive coating of this invention. The first method generally results in an abrasive composite that has a precise shape. To obtain the precise shape, the binder precursor is at least partially solidified or gelled while the abrasive slurry is present in the cavities of a production tool. The second method generally results in an abrasive composite that has a non-precise shape. In the second method, the abrasive slurry is coated into the cavities of a production tool to generate the abrasive composites. However, the abrasive slurry is removed from the production tool before the binder precursor is cured or solidified. Subsequent to this, the binder precursor is cured or solidified. Since the binder precursor is not cured while in the cavities of the production tool this results in the abrasive slurry flowing and distorting the abrasive composite shape.

For both methods, if a thermosetting binder precursor is employed, the energy source can be thermal energy or radiation energy depending upon the binder precursor chemistry. For both methods, if a thermoplastic binder precursor is employed the thermoplastic is cooled such that it becomes solidified and the abrasive composite is formed.

Figure 22:
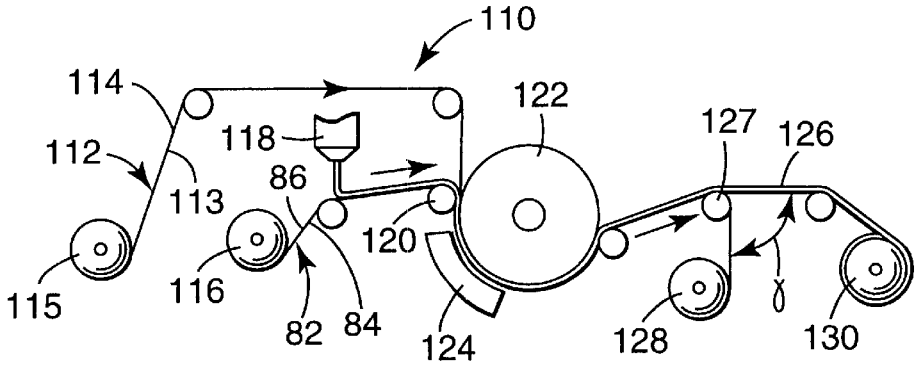
FIG. 22 is a partially schematic view of an apparatus and method for making an abrasive article with the production tool of the present invention.

FIG. 22 illustrates schematically a method and apparatus 110 for making an abrasive article. A production tool 82 made by the process described above is in the form of a web having mold surface 86, back surface 84, and two ends. A substrate 112 having a first major surface 113 and a second major surface 114 leaves an unwind station 115. At the same time, the production tool 82 leaves an unwind station 116. The mold or contacting surface 86 of production tool 82 is coated with a mixture of abrasive particles and binder precursor at coating station 118. The mixture can be heated to lower the viscosity thereof prior to the coating step. The coating station 118 can comprise any conventional coating means, such as knife coater, drop die coater, curtain coater, vacuum die coater, or an extrusion die coater. After the mold surface 86 of production tool 82 is coated, the substrate 112 and the production tool 82 are brought together such that the mixture wets the first major surface 113 of the substrate 112. In FIG. 22, the mixture is forced into contact with the substrate 112 by means of a contact nip roll 120, which also forces the production tool/mixture/backing construction against a support drum 122. It has been found useful to apply a force of 45 pounds with the nip roll, although the actual force selected will depend on several factors as is known in the art. Next, a sufficient dose of energy, preferably radiation energy, is transmitted by a radiation energy source 124 through the back surface 84 of production tool 82 and into the mixture to at least partially cure the binder precursor, thereby forming a shaped, handleable structure 126. The production tool 82 is then separated from the shaped, handleable structure 126. Separation of the production tool 82 from the shaped, handleable structure 126 occurs at roller 127. Examples of materials suitable for production tool 82 include polycarbonate, polyester, polypropylene, and polyethylene. In some production tools made of thermoplastic material, the operating conditions for making the abrasive article should be set such that excessive heat is not generated. If excessive heat is generated, this may distort or melt the thermoplastic tooling. In some instances, ultraviolet light generates heat. Roller 127 can be a chill roll of sufficient size and temperature to cool the production tool as desired. The contacting surface or mold surface 86 of the production tool may contain a release coating to permit easier release of the abrasive article from the production tool. Examples of such release coatings include silicones and fluorochemicals. The angle a between the shaped, handleable structure 126 and the production tool 82 immediately after passing over roller 127 is preferably steep, e.g., in excess of 30°, in order to bring about clean separation of the shaped, handleable structure 126 from the production tool 82. The production tool 82 is rewound on mandrel 128 so that it can be reused. Shaped, handleable structure 126 is wound on mandrel 130. If the binder precursor has not been fully cured, it can then be fully cured by exposure to an additional energy source, such as a source of thermal energy or an additional source of radiation energy, to form the coated abrasive article. Alternatively, full cure may eventually result without the use of an additional energy source to form the coated abrasive article. As used herein, the phrase "full cure" and the like means that the binder precursor is sufficiently cured so that the resulting product will function as an abrasive article, e.g. a coated abrasive article.

After the abrasive article is formed, it can be flexed and/or humidified prior to converting. The abrasive article can be converted into any desired form such as a cone, endless belt, sheet, disc, etc. before use.

Figure 23:
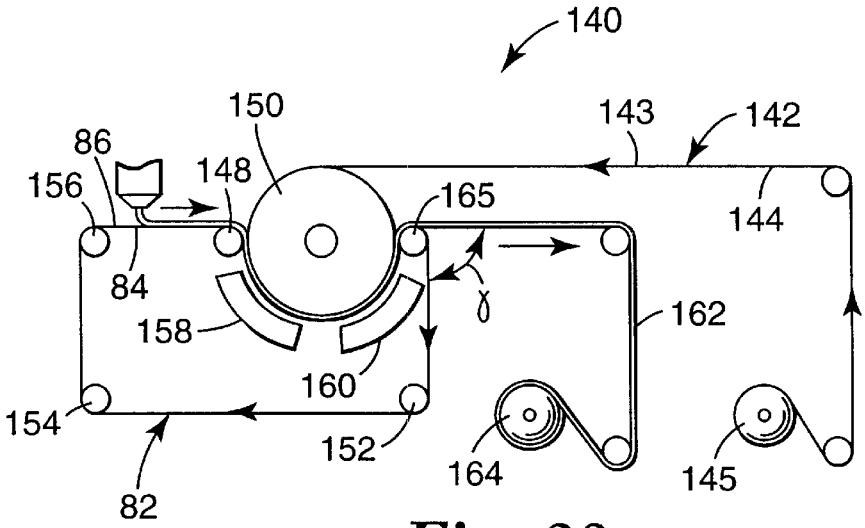
FIG. 23 is a view like FIG. 22 of an alternate embodiment of an apparatus and method.

FIG. 23 illustrates an apparatus 140 for an alternative method of preparing an abrasive article. In this apparatus, the production tool 82 is an endless belt having contacting or mold surface 86 and back surface 84. A substrate 142 having a first major surface 143 and a second major surface 144 leaves an unwind station 145. The mold surface 86 of the production tool is coated with a mixture of abrasive particles and binder precursor at a coating station 146. The mixture is forced against the first surface 143 of the substrate 142 by a contact nip roll 148, which also forces the production tool/mixture/backing construction against a support drum 150, such that the mixture wets the first major surface 143 of the substrate 142. The production tool 82 is driven over three rotating mandrels 152, 154, and 156. Energy, preferably radiation energy, is then transmitted through the back surface 84 of production tool 82 and into the mixture to at least partially cure the binder precursor. There may be one source of radiation energy 158. There may also be a second source of radiation energy 160. These energy sources may be of the same type or of different types. After the binder precursor is at least partially cured, the shaped, handleable structure 162 is separated from the production tool 82 and wound upon a mandrel 164. Separation of the production tool 82 from the shaped, handleable structure 162 occurs at roller 165. The angle a between the shaped, handleable structure 162 and the production tool 82 immediately after passing over roller 165 is preferably steep, e.g., in excess of 30°, in order to bring about clean separation of the shaped, handleable structure 162 from the production tool 82. One of the rollers, for example roller 152, can be a chill roll of sufficient size and temperature to cool production tool 82 as desired. If the binder precursor has not been fully cured, it can then be fully cured by exposure to an additional energy source, such as a source of thermal energy or an additional source of radiation energy, to form the coated abrasive article. Alternatively, full cure may eventually result without the use of an additional energy source to form the coated abrasive article.

After the abrasive article is formed, it can be flexed and/or humidified prior to converting. The abrasive article can be converted into any desired form such as a cone, endless belt, sheet, disc, etc. before use.

In either embodiment, it is often desired to completely fill the space between the contacting surface of the production tool and the front surface of the backing with the mixture of abrasive particles and binder precursor. Also in either embodiment, it is possible to apply the slurry to the substrate 112 and contact the slurry with the production tool rather than coating the slurry into the production tool and contacting the slurry with the substrate.

In a preferred method of this embodiment, the radiation energy is transmitted through the production tool 82 and directly into the mixture. It is preferred that the material from which the production tool 82 is made not absorb an appreciable amount of radiation energy or be degraded by radiation energy. For example, if electron beam energy is used, it is preferred that the production tool not be made from a cellulosic material, because the electrons will degrade the cellulose. If ultraviolet radiation or visible radiation is used, the production tool material should transmit sufficient ultraviolet or visible radiation, respectively, to bring about the desired level of cure. Alternatively, the substrate 112 to which the composite is bonded may allow transmission of the radiant energy therethrough. When the radiation is transmitted through the tool, substrates that absorb radiation energy can be used because the radiation energy is not required to be transmitted through the substrate.

The production tool 82 should be operated at a velocity that is sufficient to avoid degradation by the source of radiation. Production tools that have relatively high resistance to degradation by the source of radiation can be operated at relatively lower velocities; production tools that have relatively low resistance to degradation by the source of radiation can be operated at relatively higher velocities. In short, the appropriate velocity for the production tool depends on the material from which the production tool is made. The substrate to which the composite abrasive is bonded should be operated at the same speed as the production tool. The speed, along with other parameters such as temperature and tension, should be selected so as not to deleteriously affect the substrate or the production tool. Substrate speeds of from 15 to 76 meters/min. (50 to 250 feet/min.) have been found advantageous, however other speeds are also within the scope of the invention.

Figure 24:
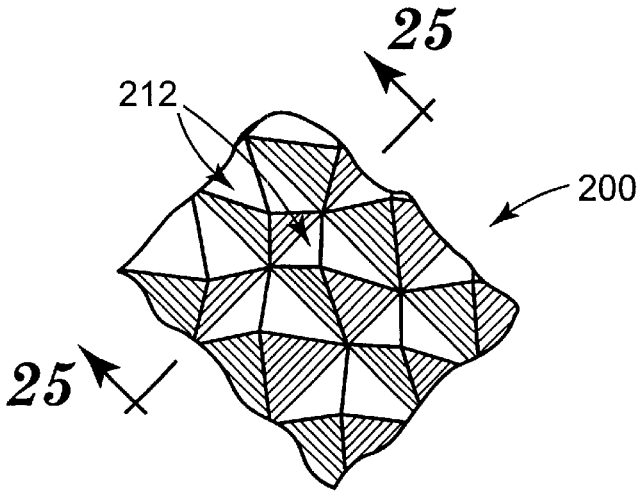
FIG. 24 is a plan view of an abrasive article made in accordance with the present invention.
Figure 25:
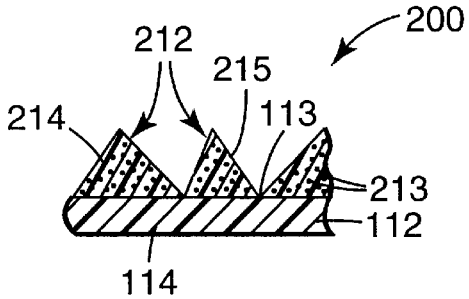
FIG. 25 is a cross-sectional view taken along line 25—25 of the abrasive article of FIG. 24.

A preferred embodiment of an abrasive article 200 provided in accordance with the above-described method is illustrated in FIGS. 24 and 25. Abrasive article 200 includes substrate 112 having first major surface 113 and second major surface 114. Structured abrasive composites 212 are bonded to first major surface 113 of substrate 112. Composites 212 comprise abrasive particles 213 dispersed in binder 214. Surfaces 215 define the precise shapes of the composites 212 as discussed above. As illustrated in FIG. 25, composites 212 can abut one another at their bases. The configuration of composites 212 will substantially conform to the configuration of the pyramids 60 on workpiece 30, and will be substantially the inverse of the pyramidal pockets 88 on production tool 82.

Further details on making structured abrasives are found in WIPO International Patent Application Publication Number WO 97/12727, published on Apr. 10, 1997, "Method and Apparatus for Knurling a Workpiece, Method of Molding an Article With Such Workpiece, and Such Molded Article," Hoopman et al., the entire disclosure of which is incorporated herein.

It is also within the scope of the present invention to make abrasive composite particles. In general, the method involves the steps of: a) coating an abrasive slurry into the cavities of a production tool; b) exposing the abrasive slurry to conditions to solidify the binder precursor, form a binder, and form abrasive composites; c) removing the abrasive composites from the production tool; and d) converting the abrasive composites into composite particles. These abrasive composite particles can be used in bonded abrasives, coated abrasives, and nonwoven abrasives. This method is described in greater detail in U.S. Pat. No. 5,549,962, "Precisely Shaped Particles and Method of Making the Same," Holmes et al., the entire disclosure of which is incorporated herein by reference.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. An apparatus for holding a cutting knurl wheel, comprising:

a main support body;

a shaft including a first end, a second end, and a longitudinal axis, wherein said shaft is rotatably mounted in said main body so as to rotate about said longitudinal axis;

a knurl wheel mount on the second end of said shaft;

a knurl wheel rotatably mounted on said knurl wheel mount so as to rotate about an knurl wheel axis, said knurl wheel including a plurality of teeth on an outer periphery thereof;

wherein said knurl wheel axis intersects said shaft longitudinal axis at an oblique angle;

whereby rotation of said knurl wheel about said knurl wheel axis defines a distal point that is the location furthest in the direction from said first end of said shaft to said second end of said shaft through which said knurl teeth pass, said distal point being on said shaft longitudinal axis; and wherein said knurl wheel mount and knurl wheel are configured such that said distal point remains located on said longitudinal axis during rotation of said shaft about said longitudinal axis.

2. An apparatus as in claim 1, wherein said shaft longitudinal axis and said knurl wheel axis intersect at an angle of from 80 to 87 degrees.

* * * * *

UNITED STATES PATENT AND TRADEMARK OFFICE

CERTIFICATE OF CORRECTION

PATENT NO. : 6,386,079 B2
DATED : May 14, 2002
INVENTOR(S) : Hoopman, Timothy L.

It is certified that error appears in the above-identified patent and that said Letters Patent is hereby corrected as shown below:

Title page,
Item [56], References Cited, OTHER PUBLICATIONS, "Instruction" should read -- Instructions --.

Signed and Sealed this

Twenty-fifth Day of March, 2003

JAMES E. ROGAN
*Director of the United States Patent and Trademark Office*